US011118551B2

(12) United States Patent
Hayashi et al.

(10) Patent No.: US 11,118,551 B2
(45) Date of Patent: Sep. 14, 2021

(54) FUEL SUPPLY DEVICE

(71) Applicant: DENSO CORPORATION, Kariya (JP)

(72) Inventors: Norihiro Hayashi, Kariya (JP); Tetsuro Okazono, Kariya (JP); Teppei Matsumoto, Kariya (JP); Yoshihisa Sanami, Kariya (JP); Kazuaki Ae, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/075,941

(22) Filed: Oct. 21, 2020

(65) Prior Publication Data

US 2021/0033053 A1 Feb. 4, 2021

Related U.S. Application Data

(63) Continuation of application No. PCT/JP2019/015406, filed on Apr. 9, 2019.

(30) Foreign Application Priority Data

Apr. 27, 2018 (JP) ..... JP2018-085914

(51) Int. Cl.
*F02M 37/10* (2006.01)
*F02M 59/48* (2006.01)
*F02M 59/44* (2006.01)

(52) U.S. Cl.
CPC ..... *F02M 59/48* (2013.01); *F02M 37/103* (2013.01); *F02M 59/44* (2013.01)

(58) Field of Classification Search
CPC ..... F02M 37/00; F02M 37/10; F02M 37/103; F02M 37/106; F02M 59/44; F02M 59/48; B60K 2015/03453; B60K 2015/03467
(Continued)

(56) References Cited

U.S. PATENT DOCUMENTS 4,945,884 A * 8/1990 Coha ..... F02M 37/103 123/509
5,678,449 A * 10/1997 Mollet ..... F02M 37/10 73/114.38

(Continued)

FOREIGN PATENT DOCUMENTS

DE 102012208517 A1 * 11/2013 ..... B60K 15/03
DE 10 2013 220 885 4/2015

(Continued)

*Primary Examiner* — John M Zaleskas
(74) *Attorney, Agent, or Firm* — Nixon & Vanderhye, PC

(57) ABSTRACT

A fuel supply device includes a pump unit, a lid unit and a strut linking unit. The pump unit is located on a bottom of a fuel tank for discharging fuel from the fuel tank to an outside thereof. The lid unit is attached to an upper wall of the fuel tank to close an opening formed in the upper wall. The lid unit has a fuel discharge port. The strut linking unit connects the lid unit to the pump unit. The strut linking unit includes an upper-side strut member, which is formed as an independent component from the lid unit. The strut linking unit includes a lower-side strut member, which is movably connected to the upper-side strut member in a vertical direction. The upper-side strut member is connected to the lid unit by a snap-fit connection. A connecting portion between the upper-side strut member and the lid unit has a stress concentration portion, which is preferentially damaged when an external force is applied to the strut linking unit.

4 Claims, 13 Drawing Sheets

(58) Field of Classification Search
USPC ..... 123/509
See application file for complete search history.

(56) References Cited

U.S. PATENT DOCUMENTS 5,762,049 A * 6/1998 Jones ..... F02M 37/10 123/509
6,260,543 B1 * 7/2001 Chih ..... B01D 35/027 123/509
6,367,650 B1 * 4/2002 Kuehnemund ..... B60K 15/03 123/514
6,890,190 B1 5/2005 Jurcak et al.
6,964,264 B2 * 11/2005 Yoshioka ..... B01D 35/26 123/509
7,074,058 B2 7/2006 Jurcak et al.
7,690,359 B2 4/2010 Price et al.
7,819,108 B2 10/2010 Froehlich et al.
2003/0002997 A1 * 1/2003 Hazama ..... F02M 37/103 417/360
2003/0106537 A1 * 6/2003 Isozaki ..... F02M 37/103 123/509
2003/0188723 A1 * 10/2003 Ichikawa ..... F02M 37/103 123/509
2003/0188724 A1 * 10/2003 Suzuki ..... F02M 37/44 123/509
2003/0188786 A1 * 10/2003 Toki ..... B01D 35/26 137/565.34
2004/0037714 A1 * 2/2004 Koba ..... F02M 37/103 417/360
2004/0055581 A1 * 3/2004 Okazono ..... F02M 37/103 123/509
2004/0168295 A1 * 9/2004 Jurcak ..... B23P 19/04 29/513
2005/0155584 A1 * 7/2005 Okazono ..... F02M 37/106 123/509
2005/0166974 A1 * 8/2005 Hashiguchi ..... F02M 37/106 137/571
2005/0178448 A1 * 8/2005 Inoue ..... F02M 37/34 137/571
2006/0073029 A1 * 4/2006 Torii ..... F02M 37/106 417/360
2006/0107930 A1 * 5/2006 Uhara ..... F02M 37/106 123/509
2006/0130815 A1 * 6/2006 Gaffield ..... F02M 37/103 123/509
2006/0213486 A1 * 9/2006 Powell ..... B67D 7/3236 123/509
2006/0219318 A1 * 10/2006 Crary ..... F02M 37/50 141/286
2006/0236982 A1 * 10/2006 Izutani ..... F02M 37/106 123/509
2006/0272619 A1 * 12/2006 Yamashita ..... F02M 37/106 123/509
2007/0044771 A1 * 3/2007 Okazono ..... F02M 37/103 123/509
2007/0056567 A1 * 3/2007 Perruchot ..... F02M 37/106 123/509
2007/0209641 A1 * 9/2007 Danjyo ..... F02M 37/106 123/495
2007/0246928 A1 * 10/2007 Price ..... F02M 37/106 280/830
2009/0165753 A1 * 7/2009 Froehlich ..... F02M 37/106 123/509
2010/0096528 A1 * 4/2010 Powell ..... F02M 37/103 248/343
2010/0096533 A1 * 4/2010 Powell ..... F02M 37/103 248/672
2010/0200595 A1 * 8/2010 Malec ..... F02M 37/103 220/567.2
2012/0060948 A1 * 3/2012 Okazono ..... F04B 23/021 137/565.17
2012/0222655 A1 * 9/2012 Powell ..... F02M 37/103 123/509
2012/0234414 A1 * 9/2012 Powell ..... B60K 15/03 137/565.37
2012/0247429 A1 * 10/2012 Powell ..... F02M 37/106 123/495
2012/0247430 A1 * 10/2012 Powell ..... F02M 37/103 123/497
2012/0247431 A1 * 10/2012 Powell ..... F02M 37/103 123/497
2012/0247590 A1 * 10/2012 Powell ..... F02M 37/106 137/565.01
2012/0251341 A1 * 10/2012 Powell ..... F04B 23/021 417/63
2013/0239931 A1 * 9/2013 Kimoto ..... F02M 37/0082 123/520
2014/0166136 A1 * 6/2014 Okazono ..... B60K 15/077 137/565.24
2014/0360602 A1 * 12/2014 Oikawa ..... F02M 37/103 137/565.17
2016/0025270 A1 * 1/2016 Masaki ..... F02M 37/106 137/565.01
2016/0089972 A1 * 3/2016 Hsu ..... B60K 15/067 137/565.37
2016/0102683 A1 * 4/2016 Hayashi ..... F02M 37/106 417/198
2016/0214477 A1 * 7/2016 Boecker ..... B29C 51/12
2016/0238172 A1 * 8/2016 Ishitoya ..... F02M 37/106
2017/0260943 A1 * 9/2017 Hayashi ..... F02M 37/025
2017/0268470 A1 * 9/2017 Murakoshi ..... F02M 37/103
2017/0268471 A1 * 9/2017 Fukui ..... F02M 37/10
2017/0276105 A1 * 9/2017 Kondo ..... F02M 37/0017
2017/0284418 A1 * 10/2017 Hanby ..... B60K 15/03
2018/0031408 A1 * 2/2018 Flynn ..... G01F 23/30
2018/0031409 A1 * 2/2018 Flynn ..... F02M 37/0076
2018/0339585 A1 * 11/2018 Hanby ..... B60K 15/03
2019/0017474 A1 1/2019 Adachi et al.
2019/0032614 A1 * 1/2019 Fukuoka ..... F02M 37/0082
2019/0078541 A1 * 3/2019 Kobayashi ..... F02M 37/0017
2019/0136809 A1 * 5/2019 Fujiseki ..... F02M 37/106
2019/0136810 A1 * 5/2019 Niwa ..... F02M 37/50
2019/0211785 A1 * 7/2019 Akiba ..... F02M 37/00
2020/0355149 A1 * 11/2020 Sato ..... F02M 37/103
2021/0025360 A1 * 1/2021 Ito ..... F02M 37/0076
2021/0025361 A1 * 1/2021 Ito ..... F02M 37/00
2021/0033051 A1 * 2/2021 Ito ..... F16M 13/022

FOREIGN PATENT DOCUMENTS

JP 2014141894 A * 8/2014 ..... B60K 15/077
JP 2015-232332 12/2015
WO WO-2004046537 A1 * 6/2004 ..... B60K 15/077
WO WO-2012022570 A1 * 2/2012 ..... F02M 37/103
WO WO-2012127680 A1 * 9/2012 ..... F02M 37/103

* cited by examiner

FUEL SUPPLY DEVICE

CROSS REFERENCE TO RELATED APPLICATION

The present application is a continuation application of International Patent Application No. PCT/JP2019/015406 filed on Apr. 9, 2019, which designated the U.S. and claims the benefit of priority from Japanese Patent Application No. 2018-085914 filed on Apr. 27, 2018. The entire disclosure of all of the above applications are incorporated herein by reference.

FIELD OF TECHNOLOGY

The present disclosure relates to a fuel supply device.

BACKGROUND

A fuel supply device is known in the art for supplying fuel from a fuel tank to an internal combustion engine of an automotive vehicle. The fuel supply device includes a pump unit located on a bottom of the fuel tank, a lid unit for closing an opening formed in an upper wall of the fuel tank, and a strut linking unit for connecting the pump unit to the lid unit. The lid unit includes a fuel discharge port for the fuel, a valve device for opening or closing a passage to be connected to a canister, an electric connector for electrically connecting the pump unit to an outside device. The strut linking unit includes an upper-side strut member and a lower-side strut member, each of which is provided in the fuel tank along its height direction, that is, in a vertical direction. The upper-side strut member is integrally formed with the lid unit, while the lower-side strut member is movably connected to the upper-side strut member in such a way that the lower-side strut member is capable of sliding with respect to the upper-side strut member. Since the lower-side strut member is movable relative to the upper-side strut member in a condition that the fuel supply device is mounted to the fuel tank, a relative movement between the lower-side strut member and the upper-side strut member can absorb an expansion and/or a contraction of the fuel tank.

In the fuel supply device of the above prior art, a stress concentration portion is provided at a lower-side portion of the lower-side strut member in such a way that the stress concentration portion will be broken before the lid unit is damaged, in order to prevent such a situation that the lid unit is damaged when an excessive contraction of the fuel tank occurs. However, in a case that an external force is applied to the strut linking unit in an intersecting direction by an oscillation of the pump unit, which is caused by oscillation of the fuel in the fuel tank, a stress may be concentrated on a part of the lid unit rather than the stress concentration portion formed at the lower side portion of the lower-side strut member. Then, the lid unit may be damaged before the stress concentration portion formed in the lower-side strut member is broken. It is, therefore, required in the field of the fuel supply device to avoid a situation that the lid unit is damaged, while the lid unit can be flexibly fitted to the fuel tanks having different sizes.

SUMMARY OF THE DISCLOSURE

It is an object of the present disclosure to provide a fuel supply device, according to which it is possible to avoid a situation that a lid unit may be damaged when an external force is applied to a strut linking device in an intersecting direction, which is perpendicular to a vertical direction.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF EMBODIMENTS

Figure 1:
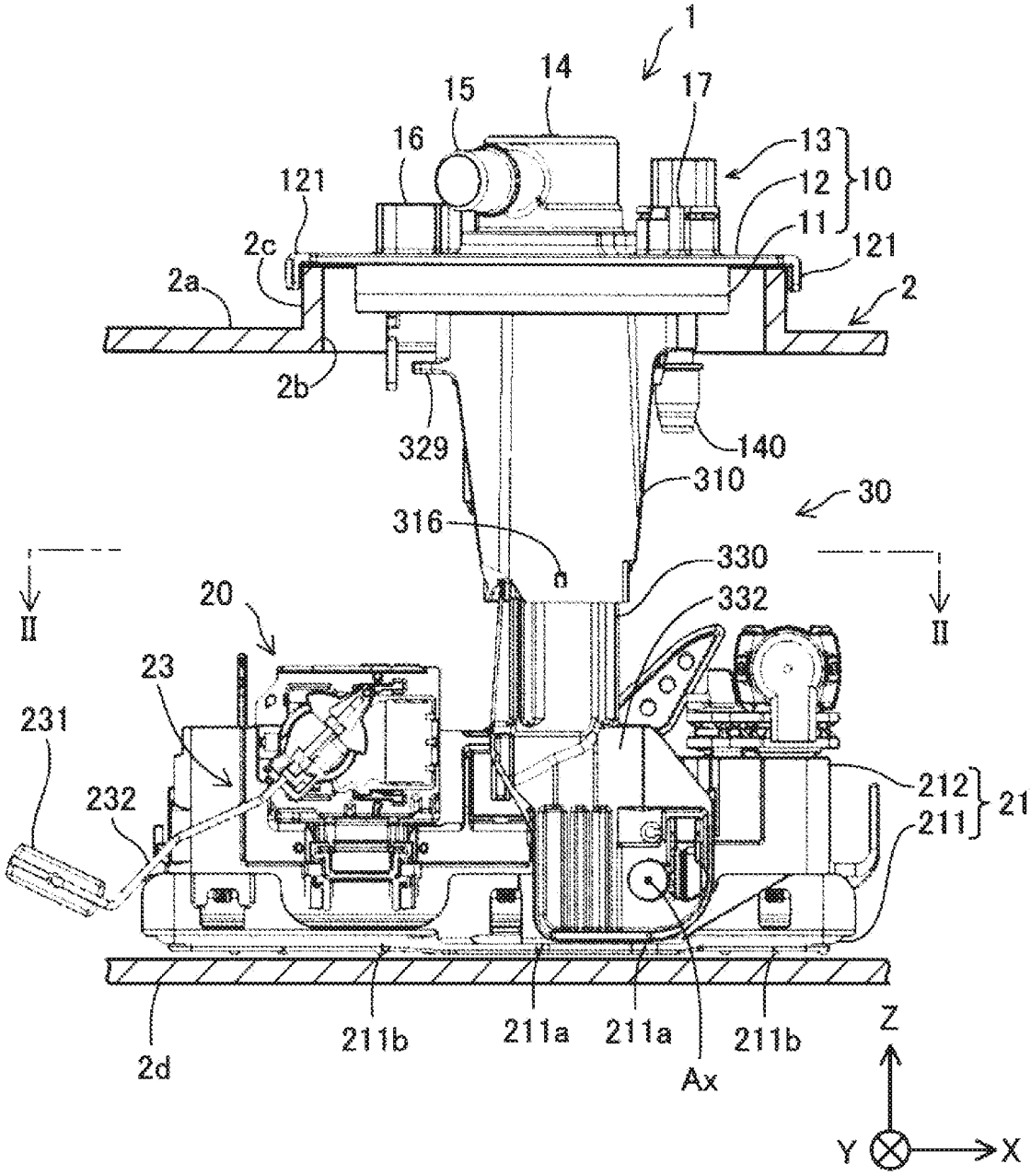
FIG. 1 is a schematic front view showing a fuel supply device according to a first embodiment of the present disclosure.

Hereinafter, multiple embodiments of the present disclosure will be explained with reference to the drawings. The same reference numerals are given to the same or similar structures and/or portions throughout the multiple embodiments and explanation thereof will be omitted.

First Embodiment (Entire Structure)

A fuel supply device 1 according to a first embodiment of the present disclosure, which is shown in FIG. 1, is assembled to a fuel tank 2 for supplying fuel from the fuel tank 2 to an outside thereof. In FIG. 1, the fuel supply device 1 is shown in a condition that it is assembled to and in the fuel tank 2. In the present embodiment, the fuel tank 2 is mounted in an automotive vehicle (not shown) and supplies the fuel from the fuel tank to a high pressure pump (not shown), which is located at the outside of the fuel tank 2. The fuel supplied to the high pressure pump by the fuel supply device 1 is further pressurized and supplied to each of fuel injection devices (not shown) for injecting the fuel into respective cylinders of an internal combustion engine (not shown) installed in the automotive vehicle. In the present embodiment, the fuel tank 2 is made of resin. Alternatively, the fuel tank 2 may be made of metal instead of the resin. An opening 2*b* is formed in an upper-side wall 2*a* of the fuel tank 2. A projecting wall portion 2*c* is formed in the upper-side wall 2*a* at a position surrounding the opening 2*b*, wherein the projecting wall portion 2*c* is projecting in an upper direction. The opening 2*b* is closed by a part of the fuel supply device 1. In FIG. 1, each of three different axes is indicated by "X", "Y" and "Z", wherein each one of the axes is perpendicular to the remaining two axes. In the condition that the fuel supply device 1 is mounted in the fuel tank 2, an X-Y plane is a plane parallel to a horizontal surface. A Z-axis corresponds to a direction parallel to a vertical direction. A −Z direction corresponds to a vertically downward direction. In the present disclosure, an X-axis direction is a collective term, which includes a +X direction and a −X direction. In a similar manner, a Y-axis direction is a collective term, which includes a +Y direction and a −Y direction. A Z-axis direction is a collective term, which includes a +Z direction and the −Z direction. In the drawings following FIG. 3, each of the X axis, Y axis and Z axis corresponds to the X axis, Y axis and X axis in FIG. 1.

The fuel supply device 1 includes a lid unit 10, a pump unit 20 and a strut linking unit 30. The lid unit 10 has an appearance configuration of a disc-plate shape. The lid unit 10 is attached to the upper-side wall 2*a* of the fuel tank 2 to close the opening 2*b*. In the present embodiment, the lid unit 10 is made of polyacetal (POM). Alternatively, the lid unit 10 can be made of polyphenylene sulfide (PPS) instead of polyacetal. In the present embodiment, each of the lid unit 10, the pump unit 20 and the strut linking unit 30 is formed as an independent component form one another.

The lid unit 10 includes a flanged portion 12, a strut supporting portion 11 and a connecting sub-unit 13. The flanged portion 12 has an appearance configuration of a disc-plate shape. An outer diameter of the flanged portion 12 is larger than an inner diameter of the opening 2*b*. A lower-side surface of the flanged portion 12 is brought into contact with an upper-side end of the projecting wall portion 2*c* to close the same. The flanged portion 12 has multiple fixing claws 121. Each of the fixing claws 121 is fixed to the projecting wall portion 2*c* of the fuel tank 2. The strut supporting portion 11 has an appearance configuration of a cylindrical shape, which extends from the lower-side surface of the flanged portion 12 in a direction to the strut linking unit 30 (a linking direction). The linking direction corresponds to a direction (the −Z direction), which extends from the lid unit 10 to the pump unit 20. The strut supporting portion 11 is inserted into the opening 2*b*, in the condition that the fuel supply device 1 is assembled to the fuel tank 2.

The connecting sub-unit 13 is formed on an upper side of the flanged portion 12 opposite to the lower-side surface having the strut supporting portion 11 in such a way that the connecting sub-unit 13 projects in a direction opposite to the linking direction (the +Z direction). The connecting sub-unit 13 is outwardly extending from the fuel tank 2. The connecting sub-unit 13 has not only a function for connecting the fuel supply device 1 to outside devices (not shown) but also a function for accommodating a valve device 400. The connecting sub-unit 13 includes a valve device accommodating portion 14, a fuel vapor discharging port 15, an electric connector 16 and a fuel discharge port 17.

Figure 6:
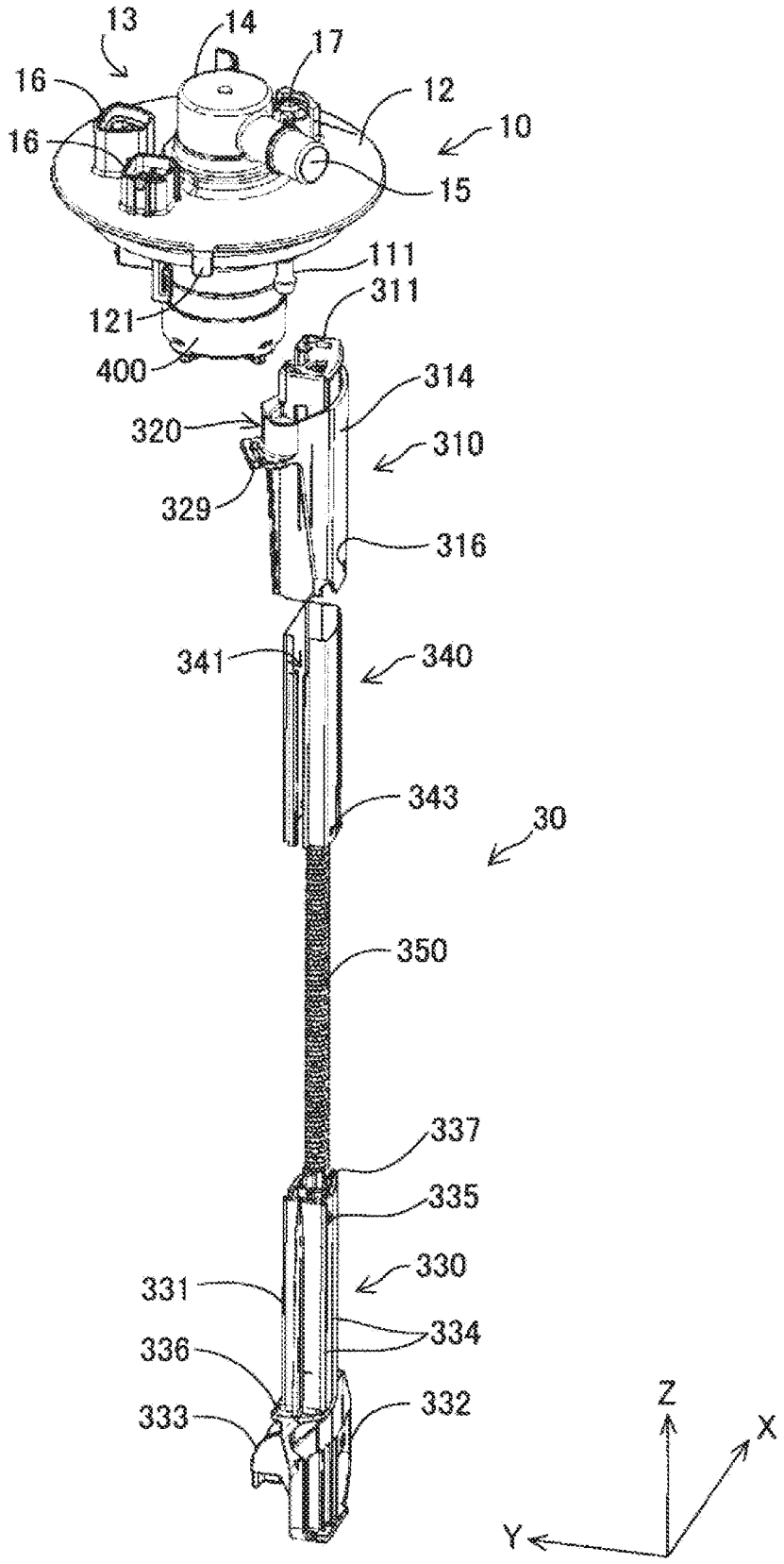
FIG. 6 is a schematically exploded perspective view showing a lid unit and a strut linking unit.

The valve device accommodating portion 14 has an appearance configuration of a cylindrical shape having a closed bottom and accommodates the valve device 400, as shown in FIG. 6. In the present embodiment, the valve device 400 controls an ON-OFF operation of a fuel vapor passage, which connects a canister (not shown) to an inside of the fuel tank 2. Alternatively, a valve device, which controls an ON-OFF operation of a fuel supply passage for supplying the fuel into the fuel tank 2, may be used as the valve device 400.

The fuel vapor discharging port 15 is connected to a pipe (not shown), which is connected to the canister, and supplies the fuel vapor from the valve device 400 to such a pipe. The electric connector 16 shown in FIG. 1 has multiple metal terminals (not shown), which electrically connect wires electrically connected to an ECU (Electronic Control Unit) (not shown) and wires electrically connected to the pump unit 20 to each other. The wires to be connected to the electric connector 16 are composed of, for example, flexible wires. The fuel discharge port 17 is connected to a fuel supply port 140, which is formed in the strut supporting portion 11. An end of a pipe (not shown) connected to the pump unit 20 is attached to the fuel supply port 140. The fuel supply port 140 supplies the fuel from the pump unit 20 to the fuel discharge port 17. The fuel discharge port 17 is connected to a high pressure pump (not shown) via a pipe (not shown), so that the fuel discharge port 17 discharges the fuel from the pump unit 20 to the high pressure pump.

Figure 2:
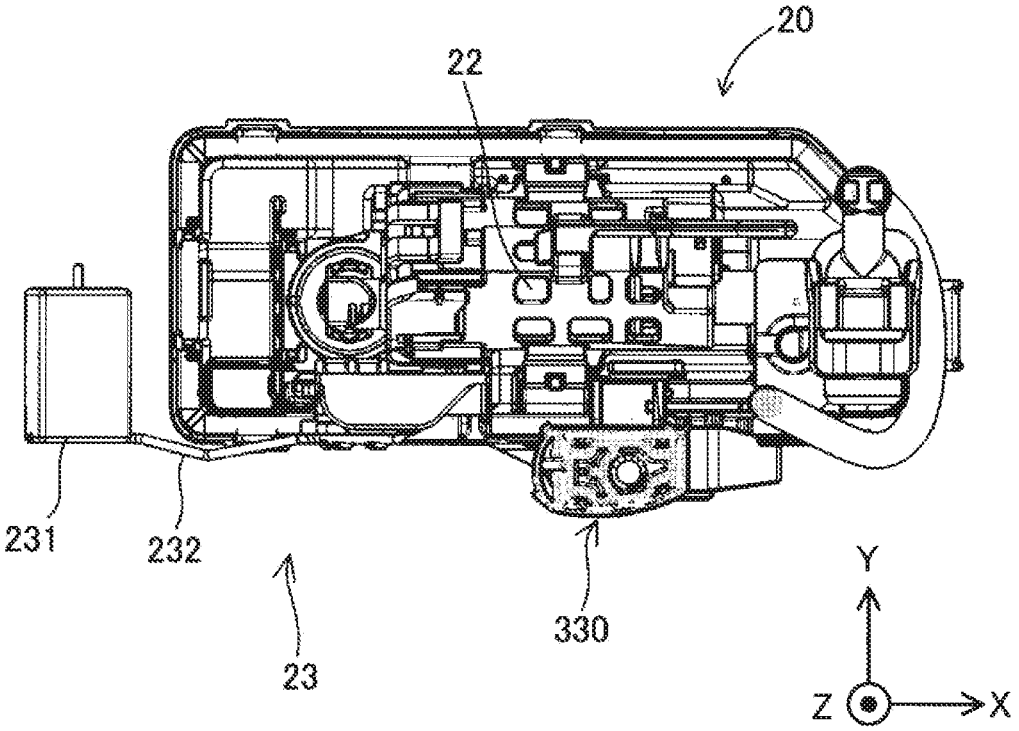
FIG. 2 is a schematic cross sectional view taken along a line II-II in FIG. 1 and showing the fuel supply device.

The pump unit 20 is located on a bottom wall 2*d* of the fuel tank 2. The pump unit 20 pumps out the fuel from the fuel tank 2 to the outside of the fuel tank 2. The pump unit 20 has an appearance configuration of an almost columnar shape, wherein a center axis direction of the pump unit 20 coincides with a horizontal direction (the X axis direction) in a condition that the pump unit 20 is located on the bottom wall 2*d* of the fuel tank 2. Accordingly, the fuel supply device 1 can be called as a horizontal-type fuel supply device. The pump unit 20 includes a sub-tank 21 shown in FIG. 1, a fuel pump 22 shown in FIG. 2 and a sender gage 23 shown in FIGS. 1 and 2. FIG. 2 shows a cross sectional view taken along a line II-II in FIG. 1.

The sub-tank 21 is composed of a lower-side part 211 and an upper-side part 212, which are connected to each other. The lower-side part 211 is made of resin and has an appearance configuration of a flat dish shape. Multiple fuel flow-in through-holes 211*a* are formed in the lower-side part 211. Each of the fuel flow-in through-holes 211*a* is formed as a through-hole passing through the lower-side part 211 in a thickness direction (an up-down direction). Multiple projections 211*b* are formed at a lower-side outer surface of the lower-side part 211, wherein each of the projections 211*b* projects in a downward direction. Each of the projections 211*b* is in contact with the bottom wall 2*d* of the fuel tank 2 in the up-down direction to form and maintain a fuel flow-in space between the lower-side part 211 and the bottom wall 2*d*. The fuel in the fuel tank 2 flows into the fuel flow-in through-holes 211*a* via the fuel flow-in space.

The upper-side part 212 is made of resin and has an appearance configuration of a reversed cup shape. An outer periphery of the upper-side part 212 is fixed to an outer periphery of the lower-side part 211. Multiple through-holes (not shown) are formed in the upper-side part 212, wherein each of the through-holes passes through the upper-side part 212 in the up-down direction. The fuel flowing into the multiple fuel flow-in through-holes 211*a* of the lower-side part 211 flows into an inside of the upper-side part 212 via the through-holes of the upper-side part 212. The fuel also flows into the inside of the upper-side part 212 from an upper side portion of the upper-side part 212. The fuel is stored in the inside of the upper-side part 212. A filter screen (not shown) is arranged at a boundary between the lower-side part 211 and the upper-side part 212. The filter screen has an appearance configuration of a flat bag shape and has a function for filtering the fuel. An outer periphery of the filter screen is interposed between the lower-side part 211 and the upper-side part 212. The filter screen is made of material having a filtering function, for example, porous resin, woven textile, nonwoven textile, resin mesh, metal mesh or the like. The fuel flowing from the lower-side part 211 into the upper-side part 212 via the through-holes (not shown) is filtered by the filter screen and then stored in the upper-side part 212.

The fuel pump 22 shown in FIG. 2 is an electrically driven type fuel pump. The fuel pump 22 draws the fuel from the sub-tank 21 and pumps out the fuel to the fuel supply port 140 via the pipe (not shown in FIG. 1). The fuel pump 22 is electrically connected to the electric connector 16 via the wire (not shown). According to the above structure, electric power is supplied to the fuel pump 22 and an operation of the fuel pump 22 is controlled by the ECU (not shown), which is connected to the electric connector 16. The fuel pump 22 may be composed of an electric pump, for example, a vane type pump, a trochoid type pump or the like.

The sender gage 23 includes a float member 231 floating on a liquid surface of the fuel in the fuel tank 2 and detects a remaining amount of the fuel in the fuel tank 2 by use of an angle of an arm member 232 connected to the float member 231. The sender gage 23 is connected to the electric connector 16 via a wire (not shown). The information for the remaining amount of the fuel, which is detected by the sender gage 23, is sent to the ECU.

The strut linking unit 30 connects the lid unit 10 to the pump unit 20. The strut linking unit 30 includes an upper-side strut member 310 and a lower-side strut member 330.

The upper-side strut member 310 is located at an upper side of the lower-side strut member 330 in the condition that the fuel supply device 1 is assembled to the fuel tank 2. In the present embodiment, the upper-side strut member 310 is made of polyacetal. Alternatively, the upper-side strut member 310 may be made of polyphenylene sulfide instead of polyacetal. The upper-side strut member 310 is connected to the lid unit 10 at an upper-side end thereof. A connection between the upper-side member 310 and the lid unit 10 will be explained below more in detail. A hook portion 329 is formed in the upper-side strut member 310. Multiple wires (not shown), such as, the wire connecting the fuel pump 22 to the electric connector 16, the wire connecting the sender gage 23 to the electric connector 16 and so on are hooked to the hook portion 329. According to the above structure, the multiple wires are bundled by the hook portion 329. Since the multiple wires are bundled by the hook portion 329, it is possible to avoid a situation that the multiple wires may get hung up by the fuel tank 2, when the fuel supply device 1 is assembled to the fuel tank 2. In addition, it is possible to suppress that positions of the respective wires may be largely changed by oscillation of the fuel, after the fuel supply device 1 has been assembled to the fuel tank 2. A stopper hole 316 is formed at a position adjacent to a lower-side end of the upper-side strut member 310.

The lower-side strut member 330 is movably connected to the upper-side strut member 310 in such a way that the lower-side strut member 330 moves in the linking direction or in a direction opposite to the linking direction in a sliding manner. A part of an upper end portion of the lower-side strut member 330 is accommodated in an inside of the upper-side strut member 310. When the lower-side strut member 330 moves in the upward direction, a range of the lower-side strut member 330, which is accommodated in the upper-side strut member 310, is increased. Thereby, an entire length of the strut linking unit 30 in the linking direction (a height of the strut linking unit 30) becomes smaller. The above linking direction corresponds to the −Z direction in FIG. 1. As a result that the lower-side strut member 330 is movably connected to the upper-side strut member 310 in the sliding manner, the length of the strut linking unit 30 in its longitudinal direction becomes telescopic. The lower-side strut member 330 includes a rotation plate member 332 at a lower-side end thereof in the linking direction. The lower-side strut member 330 is pivotally connected to the pump unit 20 at the rotation plate member 332. The rotation plate member 332 has an appearance configuration of a flat plate shape, which extends in an X-Z plane. The rotation plate member 332 is rotatably connected to a side wall of the upper-side part 212 of the pump unit 20, in such a way that the rotation plate member 332 is rotatable around a rotation axis Ax. Any stress, which is generated by an expansion or a contraction of the fuel tank 2, is transmitted to the lower-side strut member 330 from the bottom wall 2*d* of the fuel tank 2 via an intermediate member (not shown), which is interposed between a lower-side end of the rotation plate member 332 and the bottom wall 2*d* of the fuel tank 2.

As a result that the lower-side strut member 330 is pivotally connected to the pump unit 20, a connection angle of the strut linking unit 30 to the pump unit 20 becomes changeable. In the present embodiment, the connection angle is defined as an angle formed between a longitudinal direction of the strut linking unit 30 with respect to a longitudinal direction of the pump unit 20. The connection angle is almost 90 degrees (90°) in the condition of FIG. 1. The pump unit 20 and the strut linking unit 30 are located in the fuel tank 2, when the fuel supply device 1 is assembled to the fuel tank 2 by use of the structure that the connection angle of the strut linking unit 30 to the pump unit 20 is changeable. A process for assembling the fuel supply device 1 to the fuel tank 2 will be explained below.

(Process for Assembling the Fuel Supply Device 1 to the Fuel Tank 2)

A process for assembling the fuel supply device 1 to the fuel tank 2 will be explained with reference to FIGS. 3 to 5. The lid unit 10 is connected to the strut linking unit 30 in advance. The fuel supply device 1 is in advance assembled by connecting the strut linking unit 30 to the pump unit 20. A detailed structure for connecting the lid unit 10 to the strut linking unit 30 will be explained below. The strut linking unit 30 is connected to the pump unit 20 by engaging an engagement portion 333 with the upper-side part 212 of the sub-tank 21, wherein the engagement portion 333 is formed at a rear side of the rotation plate member 332 as shown in FIG. 6.

Figure 3:
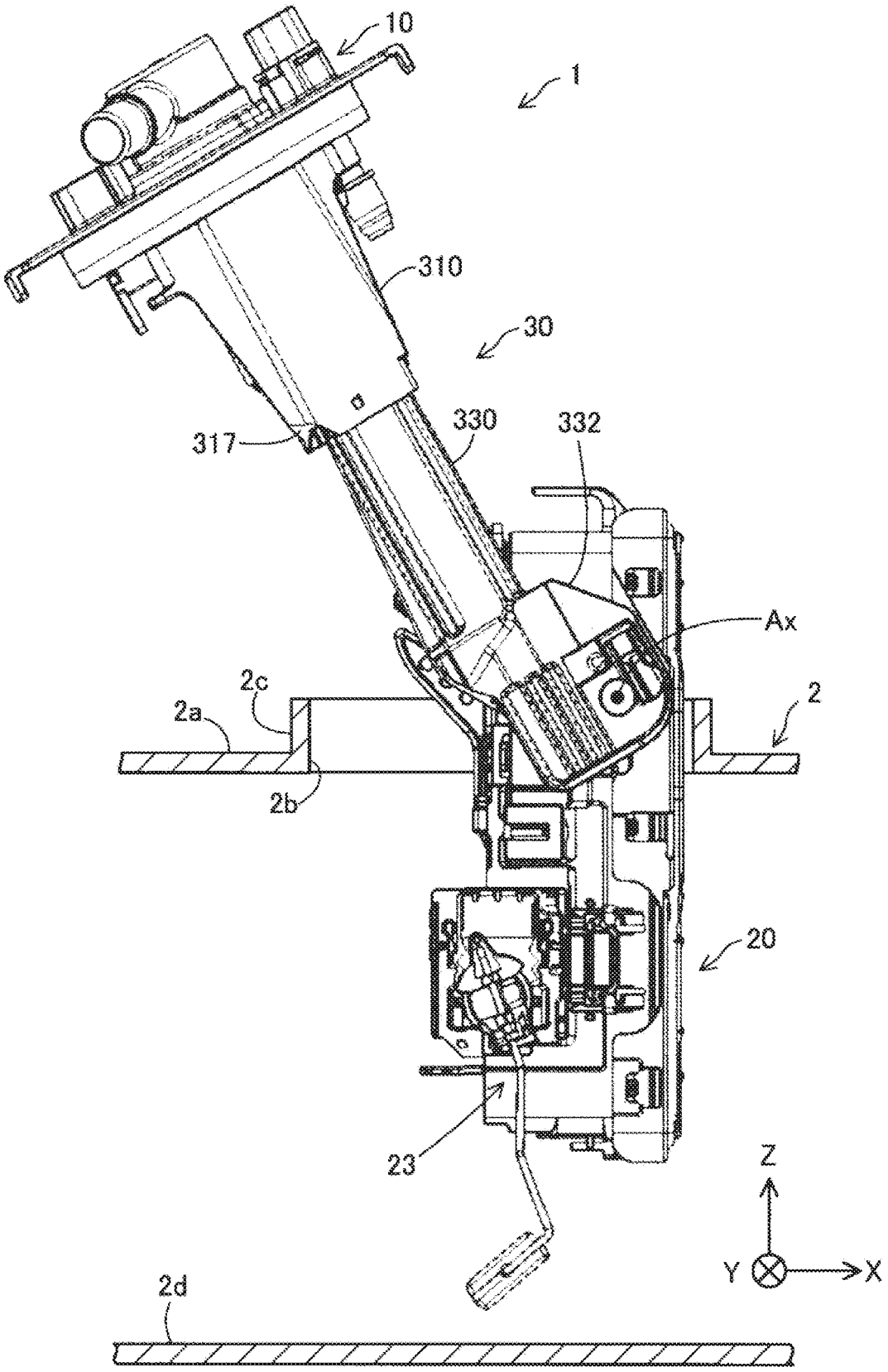
FIG. 3 is a schematic view showing one of steps for assembling the fuel supply device to a fuel tank.

As shown in FIG. 3, the strut linking unit 30 is rotated with respect to the pump unit 20 in such a way that the connection angle between them becomes smaller and the strut linking unit 30 is inclined with respect to a vertical direction. The pump unit 20 is inserted into the fuel tank 2 from the opening 2*b* of the fuel tank 2 in a condition that the strut linking unit 30 is inclined as above. During the above process, the pump unit 20 is inserted into the fuel tank 2 in an attitude that the longitudinal direction of the pump unit 20 is parallel to the vertical direction (the Z axis direction).

Figure 4:
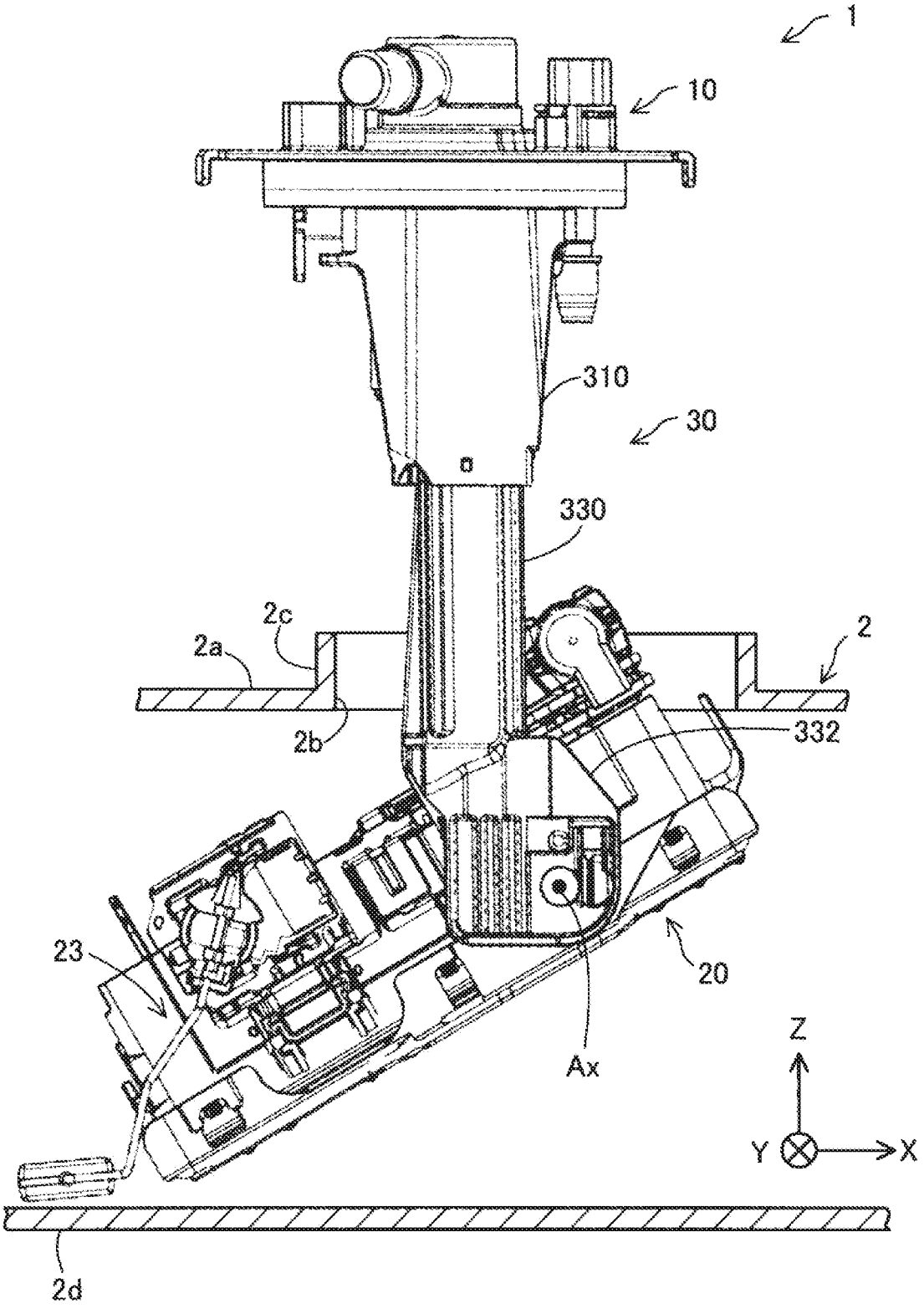
FIG. 4 is a schematic view showing another step for assembling the fuel supply device to the fuel tank.

As shown in FIG. 4, the attitude of the pump unit 20 is changed in such a way that the longitudinal direction of the pump unit 20 becomes parallel to the horizontal direction (the X axis direction and the Y axis direction), when a major part of the pump unit 20 is accommodated in the fuel tank 2. When the attitude of the pump unit 20 is changed, the rotation plate member 332 is rotated around the rotation axis Ax relative to the pump unit 20, until the longitudinal direction of the strut linking unit 30 becomes parallel to the vertical direction (the Z axis direction).

Figure 5:
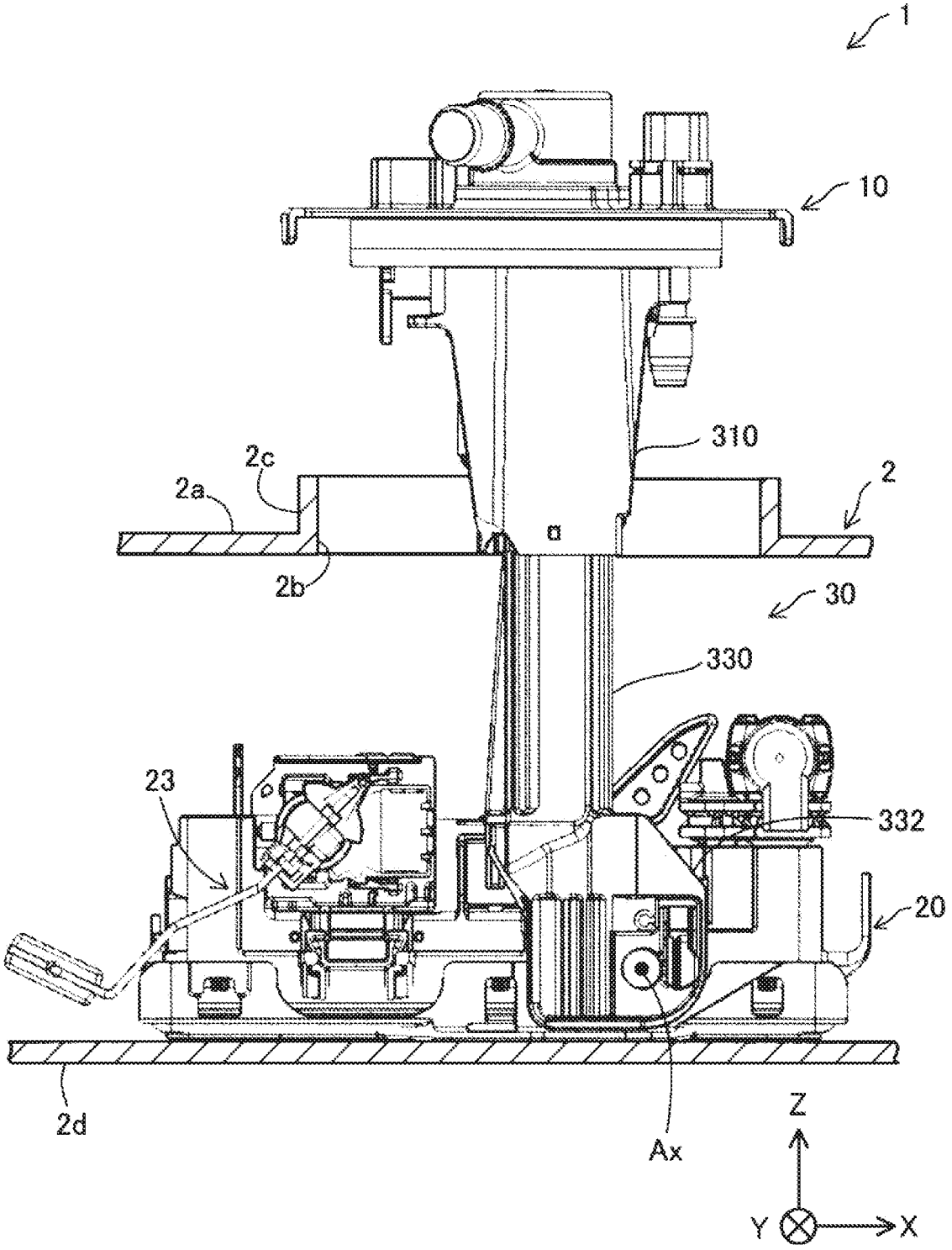
FIG. 5 is a schematic view showing a further step for assembling the fuel supply device to the fuel tank.

As shown in FIG. 5, the length of the lower-side strut member 330 is larger than a distance between the bottom wall 2*d* of the fuel tank 2 to the opening 2*b* (an upper-side end of the projecting wall portion 2*c*), in the condition that the pump unit 20 is located on the bottom wall 2*d* of the fuel tank 2. When the lid unit 10 and the upper-side strut member 310 are pushed down from the position of FIG. 5, the fuel supply device 1 is moved to the position shown in FIG. 1. In the condition of FIG. 1, the flanged portion 12 of the lid unit 10 is located at the position on the projecting wall portion 2*c* of the fuel tank 2 and the fixing claws 121 of the flanged portion 12 are fitted to the outer peripheral surface of the projecting wall portion 2*c*. When a cap member (not shown) is attached to the lid unit 10 to cover the flanged portion 12 and the projecting wall portion 2*c*, the process for assembling the fuel supply device 1 to the fuel tank 2 is completed.

(Detailed Structure of the Strut Linking Unit 30)

As shown in FIG. 6, the strut linking unit 30 includes a retainer 340 and a coil spring 350, in addition to the upper-side strut member 310 and the lower-side strut member 330. The upper-side strut member 310 is also referred to as an upper strut, while the lower-side strut member 330 is also referred to a lower strut.

(Detailed Structure of the Upper-Side Strut Member 310)

Figure 7:
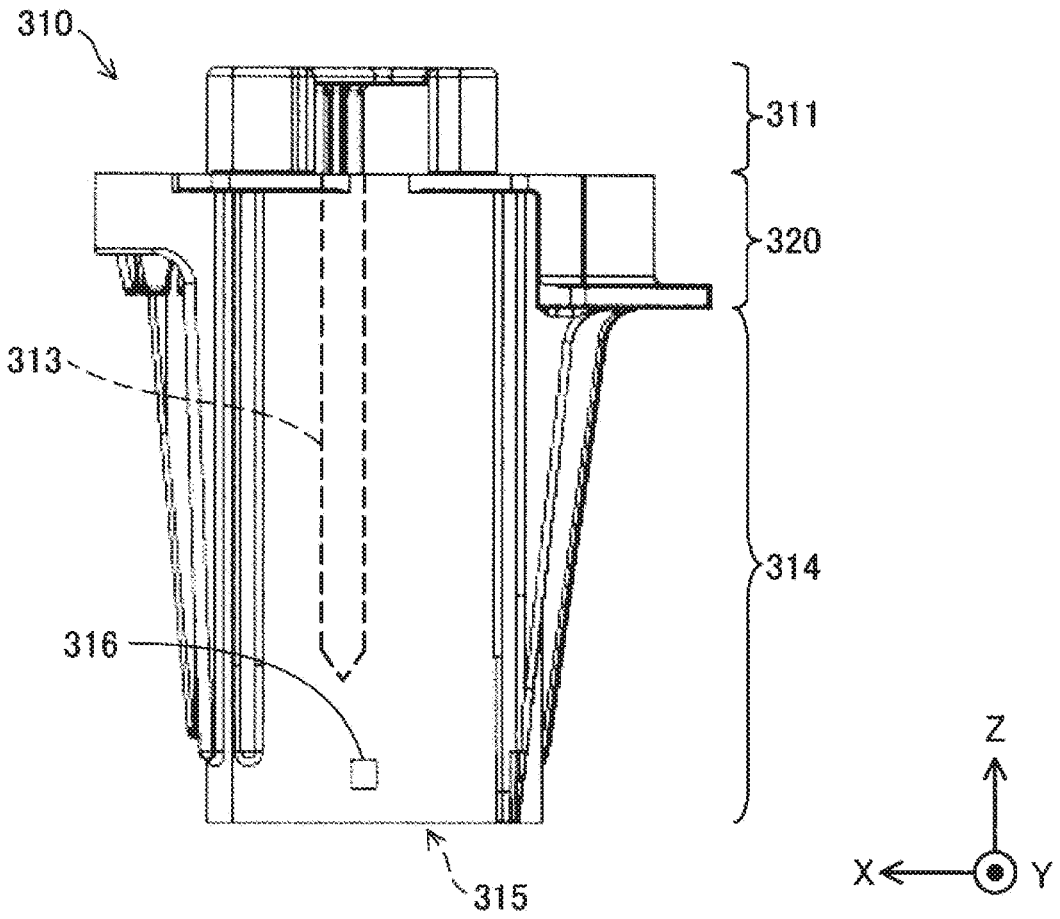
FIG. 7 is a schematic front view showing an upper-side strut member.
Figure 8:
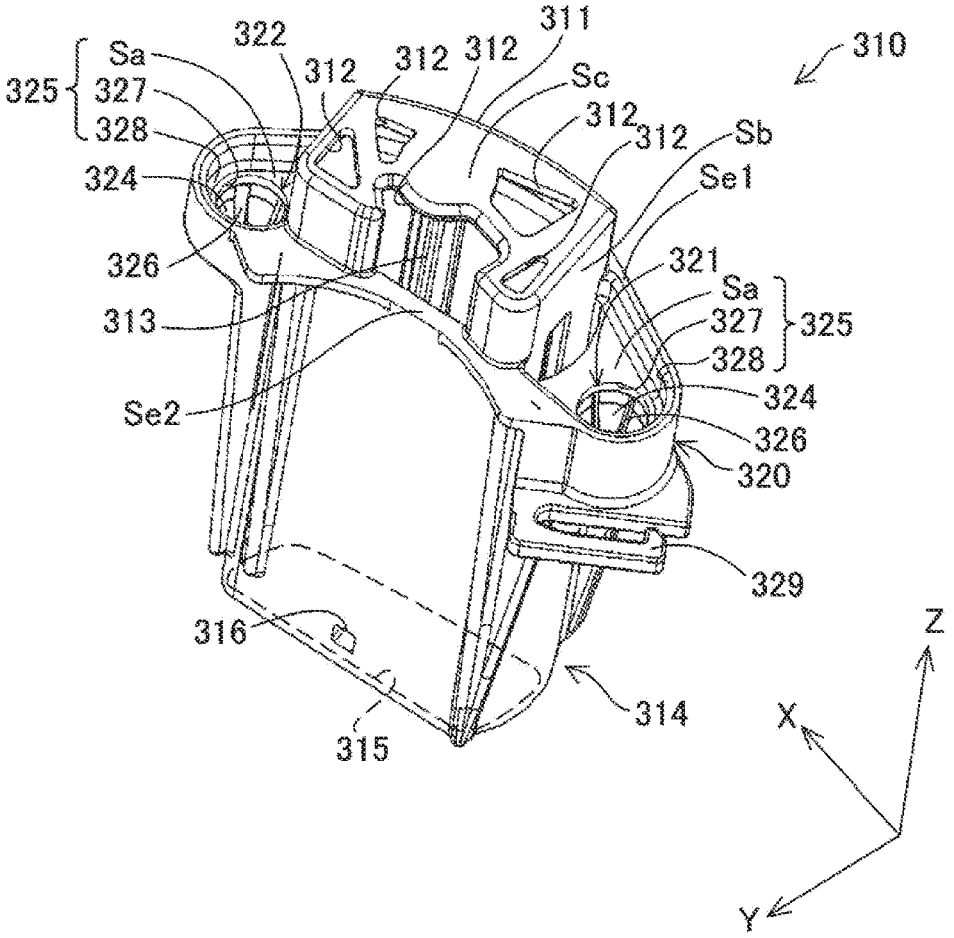
FIG. 8 is a schematic perspective view showing the upper-side strut member.
Figure 9:
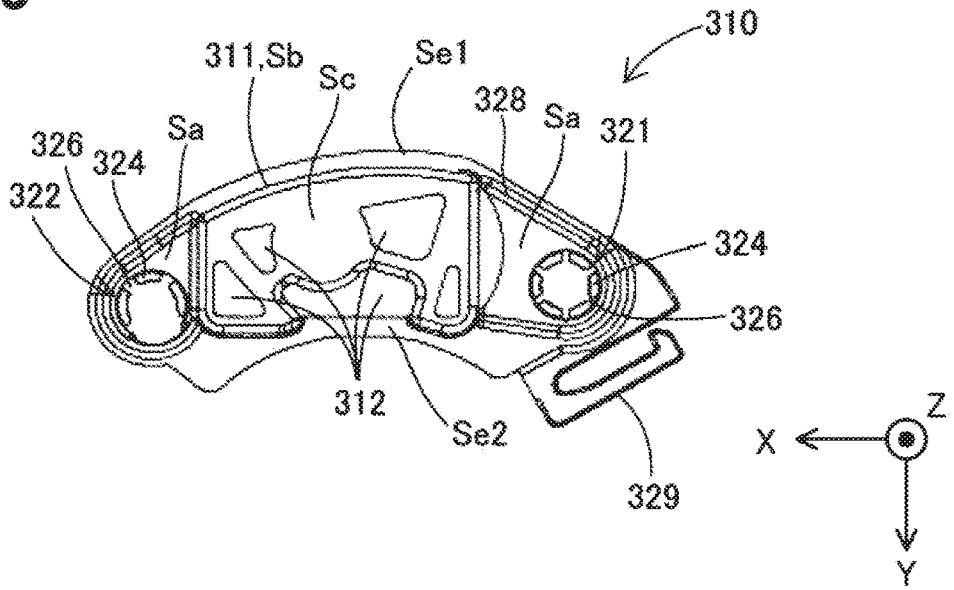
FIG. 9 is a schematic top plane view showing the upper-side strut member.

As shown in FIGS. 7 to 9, the upper-side strut member 310 is formed as the independent component from the lid unit 10 and has an appearance configuration of a hollow box shape. The upper-side strut member 310 includes a main body portion 314, a connecting portion 320 and a protruding portion 311. The main body portion 314 has an appearance configuration of a cylindrical shape and accommodates the retainer 340. In addition, the main body portion 314 accommodates an upper-side part of the coil spring 350 as well as an upper-side part of the lower-side strut member 330.

Figure 10:
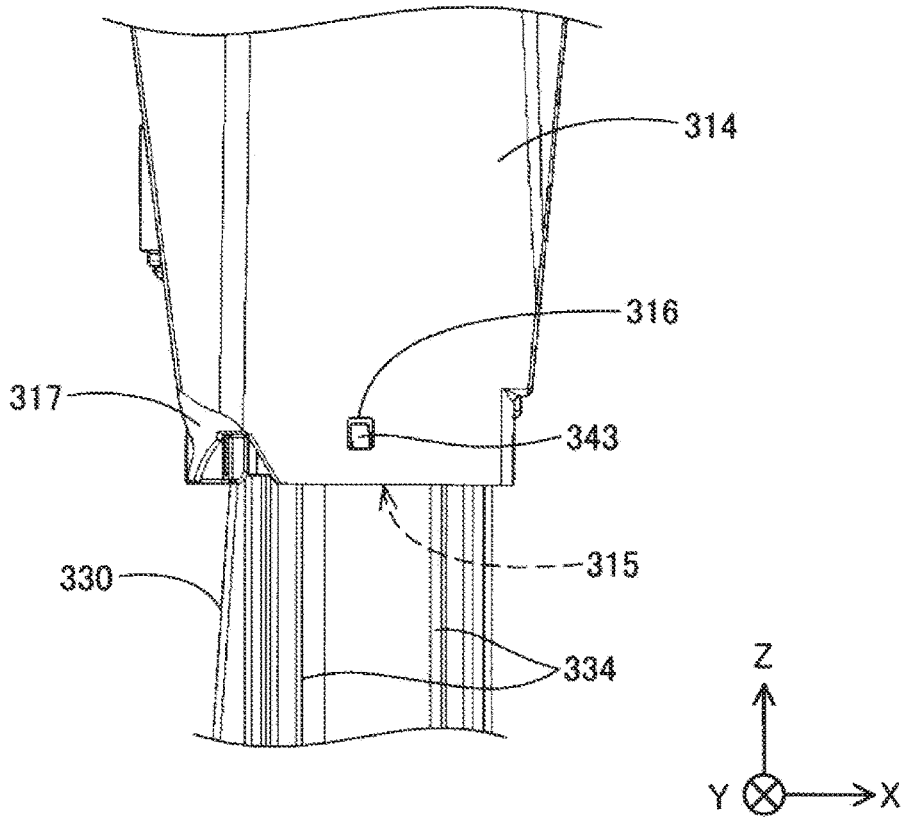
FIG. 10 is a schematic front view showing a connecting portion between the upper-side strut member and a lower-side strut member.

A cross sectional area of the main body portion 314 on a plane perpendicular to the linking direction (hereinafter, referred to as an intersecting direction), that is, on a horizontal plane, is gradually decreased in the linking direction (the downward direction). In other words, the cross sectional area of the main body portion 314 is gradually increased in the direction opposite to the linking direction and the cross sectional area is maximized at the upper-side end thereof in the opposite direction. An open end portion 315 is formed at a lower-side end of the main body portion 314 in the linking direction. In addition, the stopper hole 316 is formed at a position of the main body portion 314 adjacent to the lower-side end in the linking direction. As shown in FIG. 10, a stopper claw 343 of the retainer 340 (shown in FIG. 6) is fitted into the stopper hole 316. According to the above structure, the retainer 340 is connected to the upper-side strut member 310 in a condition that the retainer 340 is accommodated in the upper-side strut member 310. As shown in FIG. 10, a tapered surface 317 is formed in the main body portion 314 at a position adjacent to the open end portion 315. The tapered surface 317 is formed by cutting out (or sharpening) a part of the main body portion 314. In the tapered surface 317, a thickness of the main body portion 314 is gradually decreased (becomes thinner) in the linking direction. In the process for assembling the fuel supply device 1 to the fuel tank 2, more exactly, when the fuel supply device 1 is further moved in the downward direction from the position shown in FIG. 3, a portion of the upper-side strut member 310 which comes closest to the projecting wall portion 2*c* corresponds to the tapered surface 317. Since the tapered surface 317 is formed, it is possible to avoid a situation that the upper-side strut member 310 is brought into contact with the projecting wall portion 2*c* and a situation that the upper-side strut member 310 and the fuel tank 2 may be damaged.

As shown in FIGS. 7 and 8, the connecting portion 320 is formed at an upper-side end of the main body portion 314. The connecting portion 320 is used for connecting the upper-side strut member 310 to the lid unit 10. As shown in FIGS. 8 and 9, the connecting portion 320 has an arc planar shape (a shape bent in a curved form), when viewed it in the Z axis direction. A wall portion 328 is formed in the connecting portion 320 in addition to the hook portion 329, wherein the wall portion 328 extends from an outer periphery of the connecting portion 320 in the +Z direction. An end portion of the connecting portion 320 in the +Z direction, that is, an upper-side end surface of the wall portion 328 is in contact with the strut supporting portion 11, in the condition that the upper-side strut member 310 is connected to the lid unit 10. An end portion Se1 of the wall portion 328 on an outer peripheral side has an appearance configuration, which is almost the same to a configuration of an outer periphery of the strut supporting portion 11 of the lid unit 10, more exactly, a configuration of an outer periphery of an accommodation wall portion 110*a* (explained below). In a similar manner, an end portion Se2 of the wall portion 328 on an inner peripheral side has an appearance configuration, which is almost equal to a shape of an outer periphery of the accommodation wall portion 110*a* on a side of the valve device accommodating portion 14.

As shown in FIGS. 8 and 9, a center portion of the connecting portion 320 in the intersecting direction is connected to the protruding portion 311. A first fitting portion 321 and a second fitting portion 322 are formed at both sides of the connecting portion 320 in the intersecting direction. In other words, the first fitting portion 321 and the second fitting portion 322 are arranged across the protruding portion 311. The first fitting portion 321 is connected to a first boss portion 111 (explained below) of the lid unit 10 by a snap-fit engagement. The second fitting portion 322 is connected to a second boss portion 112 (explained below) of the lid unit 10 by the snap-fit engagement. The upper-side strut member 310 can be easily connected to the lid unit 10 by the respective snap-fit engagements between the first fitting portion 321 and the first boss portion 111 and between the second fitting portion 322 and the second boss portion 112. Since the first fitting portion 321 has almost the same structure to that of the second fitting portion 322, the structure of the first fitting portion 321 will be explained as a representing part.

As shown in FIGS. 8 and 9, the first fitting portion 321 includes multiple claw portions 324 and a claw supporting base portion 325. The multiple claw portions 324 are arranged in an annular form at circumferential spaces 326, wherein the multiple claw portions 324 are formed at a circumference of an insertion hole 327 formed in the connecting portion 320 and extending in its thickness direction (the Z axis direction). Each of the claw portions 324 has an appearance configuration of a thin plate shape. Each of the claw portions 324 extends not only in a direction from the circumference of the insertion hole 327 to a center of the insertion hole 327 but also in the linking direction (the −Z direction). A width of each claw portion 324 is gradually decreased in the direction to the center of the insertion hole 327 and in the linking direction (the −Z direction). The insertion hole 327 is formed at the claw supporting base portion 325. The first boss portion 111 is inserted into the insertion hole 327. The claw supporting base portion 325 has a flat surface portion Sa and the wall portion 328 formed at an outer periphery of the insertion hole 327. The claw supporting base portion 325 is connected to the multiple claw portions 324 at its circumference.

As shown in FIGS. 8 and 9, the protruding portion 311 is connected to the upper-side end of the upper-side strut member 310 in the +Z direction, namely, to the end portion on an opposite side in the linking direction. The protruding portion 311 has an appearance configuration of a box shape, which includes a cylindrical wall surface portion Sb extending from the flat surface portion Sa in the direction opposite to the linking direction, and which further includes an upper-end wall surface portion Sc formed at an end portion of the cylindrical wall surface portion Sb opposing to the flat surface portion Sa. The protruding portion 311 is accommodated in a strut accommodating portion 110 (explained below) formed in the lid unit 10, in the condition that the upper-side strut member 310 is connected to the lid unit 10. According to the above structure, the protruding portion 311 has a function as a positioning portion when the upper-side strut member 310 is connected to the lid unit 10.

Multiple through-holes 312 are formed in the cylindrical wall surface portion Sb and the upper-end wall surface portion Sc of the protruding portion 311, wherein each of the through-holes 312 passes through the respective wall surface portion in its thickness direction. As a result that the through-holes 312 are formed, stiffness of the protruding portion 311 is made smaller than stiffness of the accommodation wall portion 110*a* (explained below) of the strut accommodating portion 110 and thereby the protruding portion 311 is weakened.

The cylindrical wall surface portion Sb of the protruding portion 311 is in contact with the accommodation wall portion 110*a*, in the condition that the upper-side strut member 310 is connected to the lid unit 10. Therefore, when an external force is applied from the lower-side strut member 330 to the upper-side strut member 310 in the intersecting direction, such a stress generated by the external force is absorbed by the contact between the cylindrical wall surface portion Sb and the accommodation wall portion 110*a* and a contact by a snap-fit connection (explained below).

However, in a case that the stress to be applied is excessively large, the snap-fit connection is released as explained below and the weakened protruding portion 311 is broken, so that the connection between the upper-side strut member 310 and the lid unit 10 is released. Namely, the upper-side strut member 310 is disconnected from the lid unit 10. Accordingly, it is possible to avoid a situation that a large stress is continuously applied to the lid unit 10 and the lid unit 10 is thereby damaged.

In addition, as explained below, the upper-end wall surface portion Sc of the protruding portion 311 is not in contact with the strut supporting portion 11 (a bottom of the accommodation wall portion 110*a*), in the condition that the upper-side strut member 310 is connected to the lid unit 10. As a result, in the case that the stress (the external force) is applied from the lower-side strut member 330 to the upper-side strut member 310 in the +Z direction, it is avoided that the protruding portion 311 is going to be in contact with the strut supporting portion 11. Namely, it is possible to avoid the situation that the stress (the external force) is transmitted to the lid unit 10 and the lid unit 10 is damaged.

In the present embodiment, the large stress (the large external force) is applied from the lower-side strut member 330 to the upper-side strut member 310 in the following cases. In a first case, the fuel tank 2 is contracted and the large stress is applied by such contraction from the bottom wall 2*d* of the fuel tank 2 to the lower-side strut member 330 in the Z axis direction via the pump unit 20. In a second case, the fuel in the fuel tank 2 is largely oscillated together with the pump unit 20, for example, in a case of a vehicle collision, and the external force is applied to the lower-side strut member 330 in the intersecting direction. The fuel tank 2 is contracted in the following cases. In a first case, the fuel is continuously supplied from the fuel tank 2 to the outside thereof in a condition that the valve device 400 is closed and thereby pressure in the fuel tank 2 becomes negative. In a second case, the pressure in the fuel tank 2 is depressurized by opening the valve device 400 when the pressure in the fuel tank 2 is increased in accordance with an increase of the ambient temperature, thereafter the pressure in the fuel tank 2 is decreased in accordance with a decrease of the ambient temperature after the valve device 400 is closed, and the pressure in the fuel tank 2 becomes finally negative.

As shown in FIGS. 7 and 8, a spring guide portion 313 is formed in the protruding portion 311 at an inner wall of the upper-end wall surface portion Sc. The spring guide portion 313 has an appearance configuration of a columnar shape. The spring guide portion 313 is so arranged that it passes through an axis hole of the coil spring 350 and guides a direction when the coil spring 350 is contracted or expanded. The spring guide portion 313 is formed in an inside space of the upper-side strut member 310 in such a way that the spring guide portion 313 extends in a direction parallel to the linking direction.

(Structure of the Lower-Side Strut Member 330)

As shown in FIG. 6, the lower-side strut member 330 includes a cylindrical portion 331 in addition to the rotation plate member 332 and the engagement portion 333. In the present embodiment, the lower-side strut member 330 is made of the resin material, which is the same to the material of the upper-side strut member 310. The cylindrical portion 331 has an appearance configuration of a cylindrical shape and the rotation plate member 332 and the engagement portion 333 are formed at the lower-side end thereof in the linking direction. An open end portion 337 is formed at an upper-side end of the cylindrical portion 331 in the +Z direction. A cylindrical inside space is formed in an inside of the cylindrical portion 331, wherein the open end portion 337 is an end of the cylindrical inside space. The coil spring 350 is telescopically accommodated in the cylindrical inside space in the linking direction. Namely, the cylindrical portion 331 guides a movement of the coil spring 350 (the expansion and the contraction of the coil spring 350).

Multiple ribs 334 are formed at an outer peripheral surface of the cylindrical portion 331 in such a way that each of the ribs 334 extends in the linking direction. A joint portion 335 is formed in the cylindrical portion 331 at a position adjacent to the upper-side end in the +Z direction, in such a way that the joint portion 335 extends in the intersecting direction (in the X axis direction). The joint portion 335 is formed as a rib and built over the multiple ribs 334. The joint portion 335 is in contact with a claw portion (not shown), which is formed in an inside of the retainer 340 and at a lower-side end thereof, in a condition that the strut linking unit 30 is most expanded. The lower-side strut member 330 is prevented by such a contact between the joint portion 335 and the claw portion from being separated from the retainer 340 and the upper-side strut member 310.

A projecting portion 336 is formed at the lower side of the cylindrical portion 331, wherein the projecting portion 336 has a flanged shape and outwardly extends in the horizontal direction (in the direction along the X-Y plane). In a case that the fuel tank 2 is going to be excessively contracted beyond an initial design range, the strut linking unit 30 is also going to be largely contracted. In this case, the lower-side end of the upper-side strut member 310 is going to be brought into contact with the projecting portion 336 and thereby an excessive contraction of the strut linking unit 30 can be avoided. Accordingly, in a case that the bottom wall 2*d* is going to move in the +Z direction in accordance with the contraction of the fuel tank 2, such a movement of the bottom wall 2*d* is suppressed by the strut linking unit 30. As a result, it is possible to avoid the situation that the fuel tank 2 is excessively contracted.

(Structures of the Retainer 340 and the Coil Spring 350)

As shown in FIG. 6, the retainer 340 has an appearance configuration of a thin cylindrical shape. The retainer 340 is accommodated in the inside space of the upper-side strut member 310. An outer peripheral shape of the retainer 340 has a shape, which is almost equal to an inner peripheral shape of the upper-side strut member 310. The stopper claw 343 is formed on the outer peripheral surface of the retainer 340 at the lower-side end in the linking direction. The stopper claw 343 is engaged with the stopper hole 316 of the upper-side strut member 310. A slit 341 is formed at the upper-side portion of the retainer 340 in such a way that the slit 341 extends in the linking direction.

An upper-side portion of the lower-side strut member 330 is accommodated in the inside space of the retainer 340, in a condition that the coil spring 350 is accommodated in the lower-side strut member 330. In the present embodiment, the retainer 340 is made of metal. Any optional metal, such as, aluminum, stainless steel or the like can be used as the metal for the retainer 340. The retainer 340 not only increases the stiffness of the upper-side strut member 310 but also suppresses that a noise is generated by friction when the upper-side strut member 310 and the lower-side strut member 330 slide with each other. Since the retainer 340 and the lower-side strut member 330 are made of different materials from each other, it is possible to suppress the situation that the noise is generated when they slide with each other.

The coil spring 350 is arranged in the inside space of the lower-side strut member 330 along the linking direction. A lower-side end of the coil spring 350 is in contact with a bottom of the inside space of the lower-side strut member 330. An upper-side end of the coil spring 350 is in contact with the inner wall of the upper-end wall surface portion Sc of the protruding portion 311.

(Detailed Structure of the Lid Unit 10)

Figure 11:
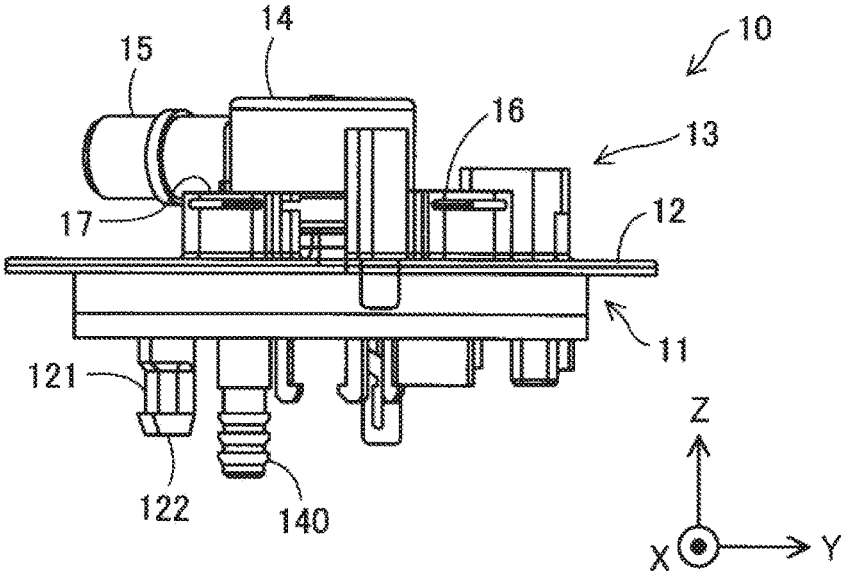
FIG. 11 is a schematic back-side view showing the lid unit.
Figure 12:
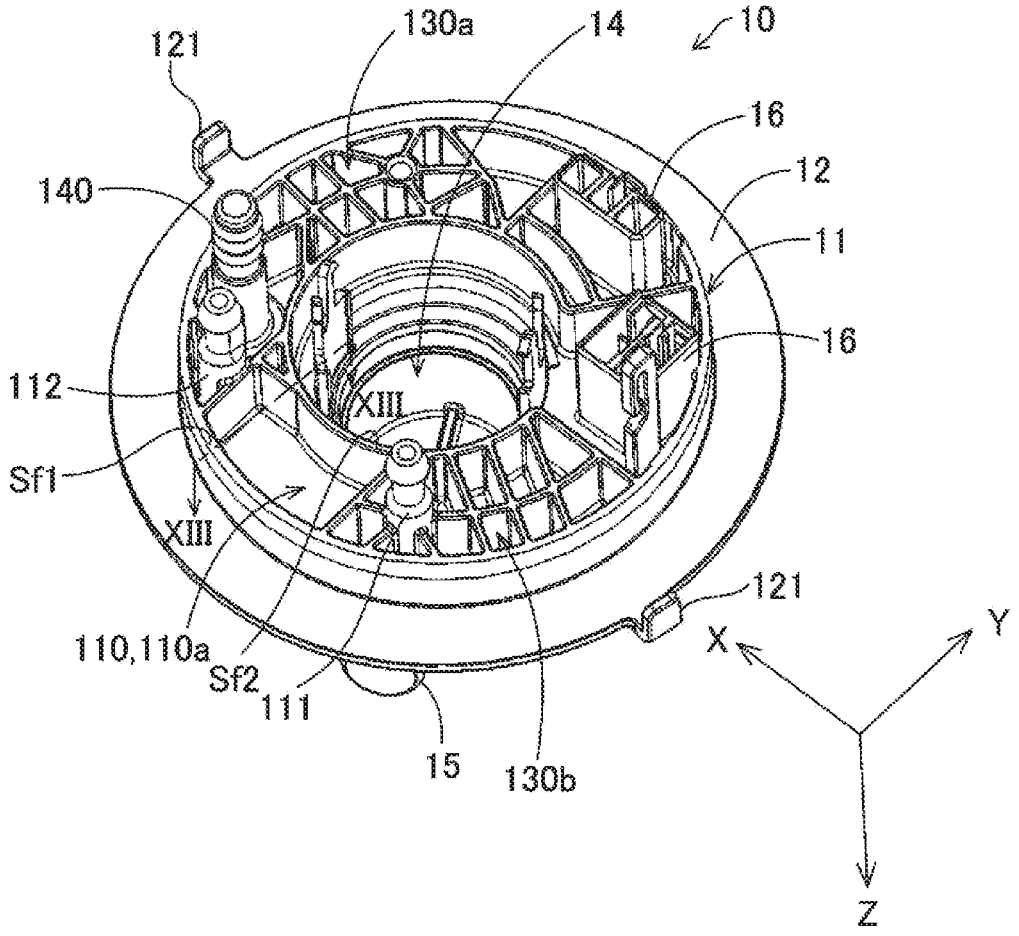
FIG. 12 is a schematic perspective view showing a bottom side of the lid unit.

As shown in FIGS. 11 and 12, the lid unit 10 is formed as the independent component from the upper-side strut member 310. In the strut supporting portion 11, the lid unit 10 includes the strut accommodating portion 110, two ribbed portions 130*a* and 130*b*, the first boss portion 111 and the second boss portion 112, in addition to the valve device accommodating portion 14, the electric connector 16 and the fuel supply port 140.

The strut accommodating portion 110 is opened in the linking direction (in the −Z direction) and formed as a recessed space in the inside of the strut supporting portion 11. The strut accommodating portion 110 is formed by the accommodation wall portion 110*a*. The accommodation wall portion 110*a* has an inner wall surface, which has a shape equal to that of an outer wall surface of the cylindrical wall surface portion Sb of the protruding portion 311. The strut accommodating portion 110 accommodates the protruding portion 311 of the upper-side strut member 310.

An outer peripheral end portion Sf1 of the accommodation wall portion 110*a* is in contact with the end portion Se1 of the outer peripheral side of the upper-side strut member 310 (FIG. 8), in the condition that the upper-side strut member 310 is connected to the lid unit 10. Each of the outer peripheral end portion Sf1 and the end portion Se1 has the same shape with each other in the planar view so that an outer peripheral wall surface of the strut accommodating portion 110 coincides with an outer peripheral wall surface of the wall portion 328 of the connecting portion 320.

An inner peripheral end portion Sf2 of the accommodation wall portion 110*a*, which is located on a side to the valve device accommodating portion 14, is in contact with the end portion Se2 of the inner peripheral side of the upper-side strut member 310 (FIG. 8), in the condition that the upper-side strut member 310 is connected to the lid unit 10. Each of the inner peripheral end portion Sf2 and the end portion Se2 has the same shape with each other in the planar view and each of the outer peripheral surfaces coincides with each other.

According to the above structure, the stress in the Z axis direction transmitted from the lower-side strut member 330 to the upper-side strut member 310 is further transmitted from the end portions Se1 and Se2 to the end portions Sf1 and Sf2. Since the end portion Se1 and the end portion Sf1 are in a surface-to-surface contact and continuously connected to each other at the outer peripheral wall surfaces, it is possible to avoid a situation that the fuel supply device 1 is hit against the projecting wall portion 2*c* of the fuel tank 2, when the fuel supply device 1 is assembled to the fuel tank 2.

Figure 13:
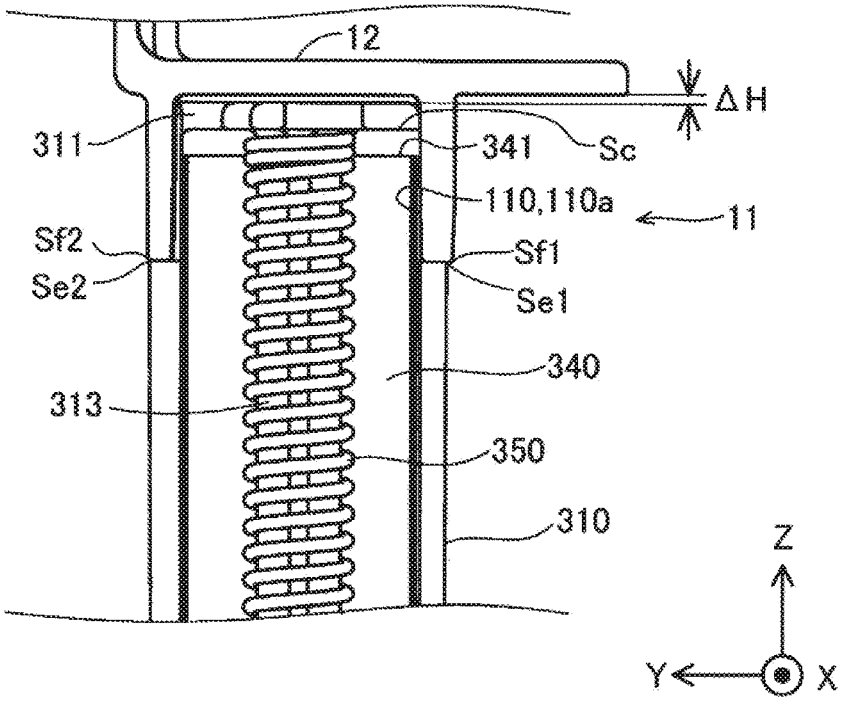
FIG. 13 is a schematically enlarged cross sectional view showing a strut supporting portion of the lid unit, which is neighboring to a protruding portion of the upper-side strut member and a strut accommodating portion of the lid unit, and showing a connecting portion between the upper-side strut member and the lid unit.

FIG. 13 schematically shows in an enlarged scale the accommodation wall portion 110*a* and its related parts in the condition that the upper-side strut member 310 is connected to the lid unit 10 (more exactly, the strut supporting portion 11 thereof). FIG. 13 shows a cross sectional view taken along a line XIII-XIII in FIG. 12, in the condition that upper-side strut member 310 is connected to the lid unit 10. As shown in FIG. 13, each of the end portions Sf1 and Sf2 of the accommodation wall portion 110*a* of the lid unit 10 is in contact with the end portions Se1 and Se2 of the connecting portion 320 of the upper-side strut member 310, in the condition that the upper-side strut member 310 is connected to the lid unit 10.

On the other hand, as shown in FIG. 13, an axial gap ΔH is formed between the upper-end wall surface portion Sc and the flanged portion 12 surrounded by the accommodation wall portion 110*a*, in the condition that the upper-side strut member 310 is connected to the lid unit 10. Therefore, it is possible to avoid a situation that the stress (the external force) in the Z axis direction transmitted from the lower-side strut member 330 to the upper-side strut member 310 is further transmitted from the protruding portion 311 to the flanged portion 12 and the lid unit 10 is thereby damaged.

As shown in FIG. 13, the upper-side end of the retainer 340 is not in contact with the protruding portion 311. Therefore, it is possible to avoid a situation that the retainer 340 (which has a high stiffness because it is made of the metal) is brought into contact with the upper-end wall surface portion Sc of the protruding portion 311 and thereby the protruding portion 311 is damaged, when the stress is applied in the Z axis direction.

Figure 14:
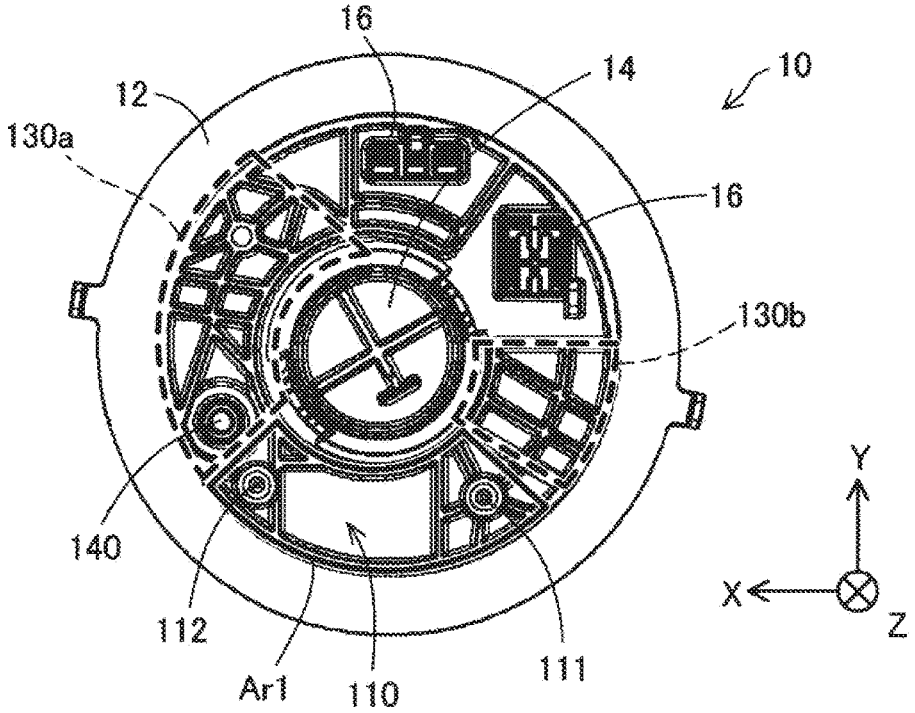
FIG. 14 is a schematic bottom view showing the lid unit.

As shown in FIG. 14, each of the ribbed portions 130*a* and 130*b* is located at a position between the valve device accommodating portion 14 and the outer periphery of the strut supporting portion 11. Each of the ribbed portions 130*a* and 130*b* is connected to a contact surface Ar1, which is a surface in contact with the upper-side strut member 310 in the condition that the upper-side strut member 310 is connected to the lid unit 10. More exactly, the ribbed portion 130*a* corresponds to an area including the fuel supply port 140 and the ribbed portion 130*a* is connected to the contact surface Ar1 at a position adjacent to the second boss portion 112. The ribbed portion 130*b* is connected to the contact surface Ar1 at a position adjacent to the first boss portion 111. The ribbed portions 130*a* and 130*b* are arranged over the contact surface Ar1.

In the drawing, the contact surface Ar1 is indicated as an area of an arc shape. In fact, the contact surface Ar1 is an annular area, which is in contact with the end portion of the wall portion 328 of the upper-side strut member 310 in the +Z direction. In each of the ribbed portions 130*a* and 130*b*, multiple ribs are formed in such a way that the ribs are projecting in the −Z direction and they are intersecting with one another. As a result that two ribbed portions 130*a* and 130*b* are formed, the stiffness of the lid unit 10 is increased. A total area of the two ribbed portions 130*a* and 130*b* is larger than an area of the contact surface Ar1. Therefore, even in a case that the stress (a compression load) is applied from the upper-side strut member 310 to the lid unit 10, that is, to the contact surface Ar1 of the lid unit 10, it is possible to diverge the stress transmitted to the lid unit 10 into the inside of the lid unit 10 via the two ribbed portions 130*a* and 130*b* which are connected to the contact surface Ar1. It is, therefore, possible to avoid a situation that the lid unit 10 is damaged. The ribs are also formed in an area surrounding the strut accommodating portion 110.

As shown in FIG. 12, each of the first boss portion 111 and the second boss portion 112 has an appearance configuration of a columnar shape extending from the strut supporting portion 11 in the linking direction (in the direction to the pump unit 20). Each of the first boss portion 111 and the second boss portion 112 is more projecting in the linking direction (in the −Z direction) than the ribbed portions 130*a* and 130*b*.

Figure 15:
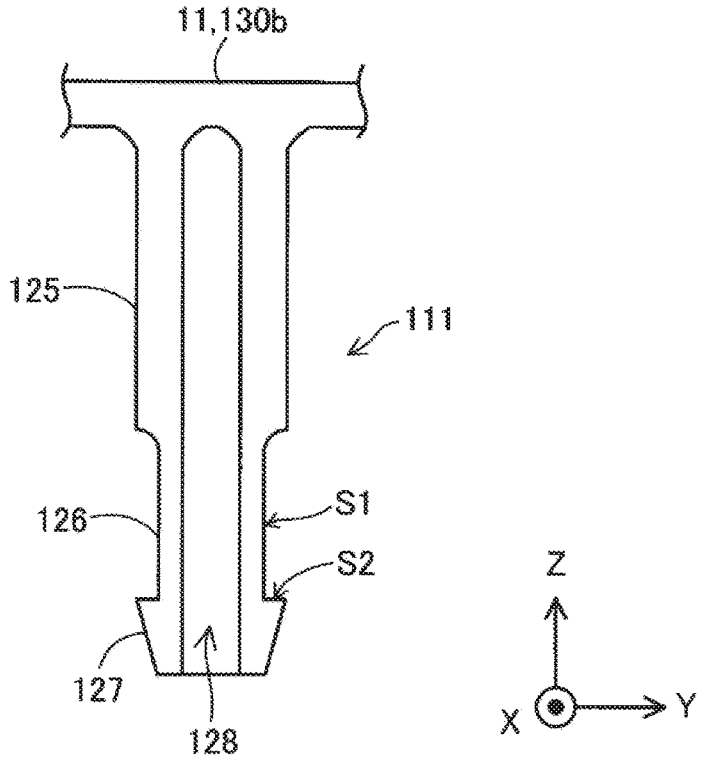
FIG. 15 is a schematically enlarged view showing a first boss portion.

FIG. 15 shows a cross section of the first boss portion 111 on a plane parallel to a Z-Y plane. As shown in FIGS. 12 and 15, each of the first boss portion 111 and the second boss portion 112 has an appearance configuration of a columnar shape projecting from the strut supporting portion 11 in the linking direction. As explained above, the first boss portion 111 is snap-fitted to the first fitting portion 321 of the upper-side strut member 310, while the second boss portion 112 is snap-fitted to the second fitting portion 322 of the upper-side strut member 310. Since the first boss portion 111 has the same structure to that of the second boss portion 112, the structure of the first boss portion 111 will be explained as a representing part.

As shown in FIG. 15, the first boss portion 111 has a forward end portion 127, a front-side portion 126 and a base body portion 125. An axial hole 128 extending in the linking direction is formed in an inside of the first boss portion 111.

The forward end portion 127 is located at an axial end of the first boss portion 111 in the linking direction. As shown in FIGS. 12 and 15, the forward end portion 127 has an appearance configuration of a trapezoidal shape having the axial hole 128. A cross section of the forward end portion 127 on a plane of the intersecting direction (that is, a plane in parallel to the X-Y plane) is gradually decreased in the linking direction. The claw portions 324 of the first fitting portion 321 are engaged with the forward end portion 127, in the condition that the upper-side strut member 310 is connected to the lid unit 10 by snap-fitting the first boss portion 111 to the first fitting portion 321. The engagement between the upper-side strut member 310 and the lid unit 10 is achieved by contacts between the forward end portion 127 and the claw portions 324. When the stress is applied to the upper-side strut member 310, the stress concentrates on the forward end portion 127 of the lid unit 10. Namely, the forward end portion 127 works as a stress concentrating portion.

The front-side portion 126 is a part of the first boss portion 111, which is located at a front side of the first boss portion 111 except for the forward end portion 127. In other words, the front-side portion 126 is a middle part of the first boss portion 111 between the base body portion 125 and the forward end portion 127. The base body portion 125 is a part of the first boss portion 111, which is connected to the front-side portion 126 and located at a position opposite to the forward end portion 127. Each of the front-side portion 126 and the base body portion 125 has an appearance configuration of the columnar shape having inside the axial hole 128. As shown in FIG. 15, a thickness of the front-side portion 126 is smaller than that of the base body portion 125. The base body portion 125 is connected to the front-side portion 126 in the linking direction, while it is connected to a bottom portion of the ribbed portion 130*b* of the strut supporting portion 11 in the direction opposite to the linking direction.

A connecting portion between the front-side portion 126 and the forward end portion 127 will be explained. As explained above, the forward end portion 127 has the appearance configuration of the trapezoidal shape. An outer peripheral surface of the forward end portion 127 is connected to an outer peripheral surface S1 of the front-side portion 126 via an axial end surface S2, which is formed at an upper-side axial end of the forward end portion 127 in the +Z direction and which is formed in an annular shape (a circular shape having a hole at its center). The outer peripheral surface S1 of the front-side portion 126 is a cylindrical surface, which is connected to the axial end surface S2 of the annular shape of the forward end portion 127. In other words, the connection between the outer peripheral surface of the front-side portion 126 and the axial end surface of the forward end portion 127 is achieved by a connection of the different surfaces (the outer peripheral surface S1 and the axial end surface S2).

According to the above structure, it is possible to design the forward end portion 127 in such a way that it is easily broken when the stress is applied to the first boss portion 111. More exactly, a crack is generated at the connecting portion between the different surfaces as a basing point, when the stress is applied from the claw portions 324 to the forward end portion 127. Then, the forward end portion 127 is damaged and easily broken away from the first boss portion 111. As above, since the forward end portion 127 works as the stress concentration portion, the forward end portion 127 is preferentially damaged and the engagement between the first boss portion 111 and the first fitting portion 321 is released, when the large stress is applied to the upper-side strut member 310 via the lower-side strut member 330. As a result, the connection between the upper-side strut member 310 and the lid unit 10 is released. It is, therefore, possible to avoid a situation that the stress applied to the upper-side strut member 310 is transmitted to the lid unit 10. It is possible to avoid a situation that the lid unit 10 is damaged. In a case that a small stress, which may not damage the forward end portion 127, is applied to the upper-side strut member 310, the stress is transmitted to the strut accommodating portion 110 (the accommodation wall portion 110*a*) via the protruding portion 311. The lid unit 10 including the two ribbed portions 130*a* and 130*b* receives and absorbs the stress as a whole.

Figure 16:
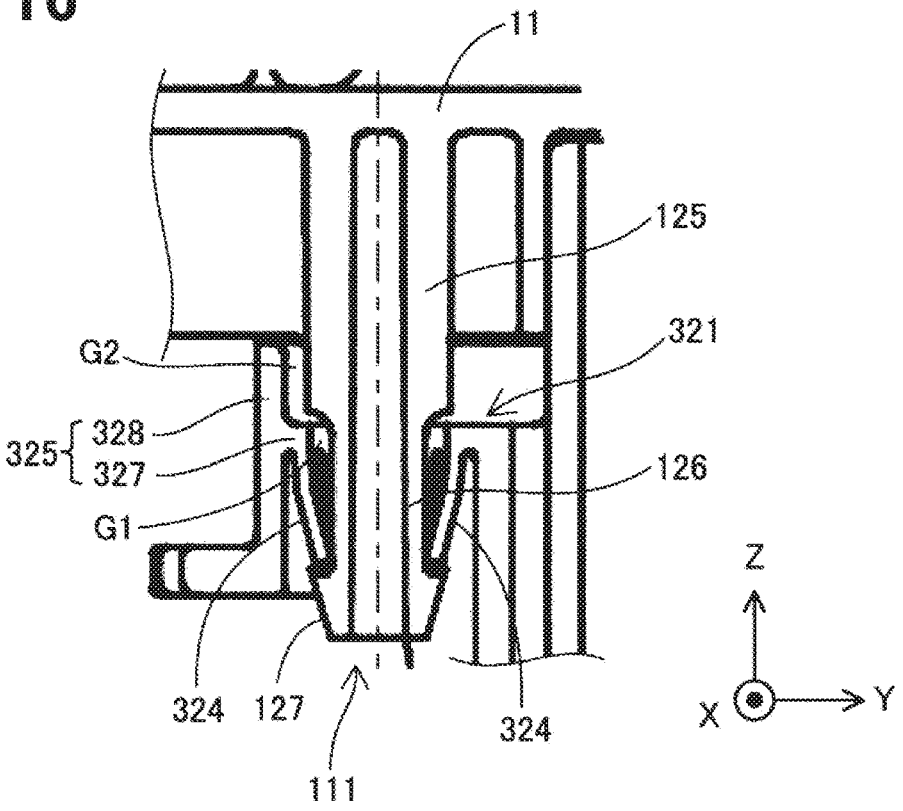
FIG. 16 is a schematically enlarged view showing a connecting portion between the first boss portion and a first fitting portion.

FIG. 16 is a schematically enlarged cross sectional view showing the connecting portion (the engagement portion) between the first boss portion 111 and the first fitting portion 321 in the condition that the upper-side strut member 310 is connected to the lid unit 10. As shown in FIG. 16, the first boss portion 111 is inserted into the insertion hole 327. An end of each claw portion 324 in the linking direction is in contact with the forward end portion 127 of the first boss portion 111, more exactly, in contact with a connecting boundary portion between the outer peripheral surface S1 of the front-side portion 126 and the axial end surface S2 of the forward end portion 127.

A first radial gap G1 is formed between the front-side portion 126 of the first boss portion 111 and the claw supporting base portion 325 (the insertion hole 327) of the upper-side strut member 310. A second radial gap G2 is formed between the base body portion 125 of the first boss portion 111 and the claw supporting base portion 325 (the wall portion 328) of the upper-side strut member 310. Therefore, when the stress is applied to the upper-side strut member 310 from the lower-side strut member 330, the stress is transmitted not to the front-side portion 126 and the base body portion 125 but to the forward end portion 127 via the claw portions 324 of the upper-side strut member 310. As a result, the stress is concentrated on the forward end portion 127 and the forward end portion 127 is preferentially damaged. In other words, the stress is absorbed by the forward end portion 127.

In the above situation, the snap-fit engagement between the first boss portion 111 and the first fitting portion 321 is released and the connection between the upper-side strut member 310 and the lid unit 10 is released. As explained above, since the axial gap ΔH is formed between the strut supporting portion 11 of the lid unit 10 and the protruding portion 311 of the upper-side strut member 310, it is possible to avoid a situation that the protruding portion 311 of the upper-side strut member 310 is brought into contact with the strut supporting portion 11 of the lid unit 10 in the +Z direction.

In a case that the stress transmitted to the upper-side strut member 310 is very large and such a large stress cannot be absorbed by only the break-down of the forward end portion 127, a part of the stress is absorbed by a deformation of the protruding portion 311 when it collides against the accommodation wall portion 110*a* (more exactly, an upper-end wall portion). The protruding portion 311 is weakened by the multiple through-holes 312. Accordingly, it is also possible even in this case to avoid a situation that the stress is transmitted to the flanged portion 12 of the lid unit 10. Since each of the first boss portion 111 and the second boss portion 112 is projecting in the linking direction from the ribbed portions 130*a* and 130*b*, a break-down position (the position of the forward end portion 127) is largely separated from most of the strut supporting portion 11, the flanged portion 12 and the connecting sub-unit 13, when the forward end portion 127 is broken down by the stress concentration. It is, therefore, possible to surely avoid the situation that the stress is transmitted to the flanged portion 12.

In the fuel supply device 1 of the first embodiment, the upper-side strut member 310 is formed as the independent component from the lid unit 10. It is, therefore, possible to select one of the lid units 10, which is suitable to the strut linking unit 30, when the strut linking unit 30 suitable for a size of the fuel tank 2 is used.

As above, it is possible to flexibly meet requirements for different sizes of the fuel tank 2, while it is avoided that the lid unit 10 is damaged by the stress transmitted to the lid unit 10 via the strut linking unit 30. In a case that it is necessary to prepare the lid unit 10 depending on a layout of a position for the fuel tank 2, it is sufficient to change only the lid unit 10 except for the strut linking unit 30. It is possible to reduce a manufacturing cost for the fuel supply device.

As explained above, the upper-side strut member 310 is formed as the independent component from the lid unit 10. When compared the structure of the present embodiment with a comparison example, in which the upper-side strut member and the lid unit are integrally formed as one unit, it is possible in the present embodiment to make a size of each component smaller before they are assembled together even in a case that a final size of the assembled condition is the same to that of the comparison example. It is thereby possible to make a volume of the resin smaller for each of the components when manufacturing them. In other words, it is possible to reduce a time for cooling each of resin-formed components and to reduce a manufacturing time. In addition, it is possible to make smaller a size of a metallic mold for each component to thereby reduce a manufacturing cost of the fuel supply device 1 as a whole, including the cost for manufacturing the metallic molds.

In addition, since the upper-side strut member 310 and the lid unit 10 are formed as the independent component from each other, it is possible to manufacture each of the components with different resins. For example, the lid unit 10 can be made of the resin having high acid resistivity, such as, polyphenylene sulfide, while the upper-side strut member 310 may be made of the resin having high economic efficiency, such as, polyacetal.

Since the connecting portion (the engagement portion) between the lid unit 10 and the upper-side strut member 310 forms the stress concentration portion (the forward end portion 127), the forward end portion 127 is preferentially damaged compared with the other parts of the lid unit 10, when the stress is applied to the strut linking unit 30 in the intersecting direction, for example, when the fuel is oscillated by the collision of the automotive vehicle and thereby the pump unit 20 is oscillated. It is thereby possible to avoid the situation that those parts of the lid unit 10 other than the first and the second boss portions 111 and 112 of the strut supporting portion 11, such as, the flanged portion 12 and the connecting sub-unit 13, are damaged. It is therefore possible to prevent a leakage of the fuel from the fuel tank 2.

Since the forward end portion 127 of each of the first and the second boss portions 111 and 112, which are snap-fitted to the claw portions 324 of the fitting portions of the upper-side strut member 310, works as the stress concentration portion, it is possible to transmit the stress to the forward end portion 127 via the claw portions 324 when the stress is applied to each of the lower-side strut member 330 and the lower-side end of the upper-side strut member 310 in the intersecting direction. In addition, the forward end portion 127 has a function for connecting the upper-side strut member 310 to the lid unit 10 by the snap-fit engagement. When compared the above structure of the present embodiment with a comparative example, in which one of portions is formed in such a way that it does not have a function for the connection but only has a function for the stress concentration, it is possible in the present embodiment to reduce the manufacturing cost for the lid unit 10 and the upper-side strut member 310.

In addition, in each of the first and the second boss portions 111 and 112, the thickness of the front-side portion 126 is smaller than that of the base body portion 125 and the outer peripheral surface of the front-side portion 126 and the axial end surface of the forward end portion 127 are connected to each other by the surfaces S1 and S2, which are different from each other. When compared the above structure of the present embodiment with a comparative example, in which the front-side portion and the forward end portion are connected to each other by a single outer surface, the forward end portion 127 of the present embodiment is more easily damaged when the stress is applied to the forward end portion 127 (working as the stress concentration portion) via the claw portions 324. It is thereby possible to more surely avoid the situation that those parts of the lid unit 10 other than the first and the second boss portions 111 and 112 of the strut supporting portion 11, such as, the flanged portion 12 and the connecting sub-unit 13, are damaged.

In addition, each of the first and the second radial gaps G1 and G2 is formed between each of the first and the second boss portions 111 and 112 and each of the claw supporting base portions 325 of the upper-side strut member 310, in the condition that the first and the second boss portions 111 and 112 are snap-fitted to the claw portions 324. It is possible to avoid the situation that the stress is transmitted to each of the first and the second boss portions 111 and 112 from the respective claw supporting base portion 325, even in the case that the stress is applied to the strut linking unit 30 by the oscillation of the fuel and so on. It is, therefore, possible to avoid the situation that the stress is applied to any portions of the respective boss portions 111 and 112, except for the forward end portion 127 (the stress concentration portion). It is thereby possible to more surely avoid the situation that those parts of the lid unit 10 other than the first and the second boss portions 111 and 112 of the strut supporting portion 11, such as, the flanged portion 12 and the connecting sub-unit 13, are damaged.

In addition, since the upper-side strut member 310 has the protruding portion 311 and the lid unit 10 has the strut accommodating portion 110, it is possible to easily position the upper-side strut member 310 to the lid unit 10 when they are assembled together to each other.

In addition, since the cross sectional area in the intersecting direction of the connecting portion between the upper-side strut member 310 and the lid unit 10 is larger than the cross sectional area in the intersecting direction of the connecting portion between the upper-side strut member 310 and the lower-side strut member 330, it is possible to disperse the stress across a wider area of the lid unit 10 when the stress is applied to the lower-side strut member 330 by the oscillation of the fuel or the like. Therefore, it is possible to protect the lid unit 10 from the damage.

In addition, since the strut supporting portion 11 has the ribbed portions 130*a* and 130*b*, which are wider than the contact surface Ar1 between the lid unit 10 and the upper-side strut member 310, it is possible to disperse the stress across the wider ribbed portions 130*a* and 130*b*, when the stress is applied from the upper-side strut member 310 to the lid unit 10. Therefore, it is possible to protect the lid unit 10 from the damage.

In addition, since the upper-side strut member 310 and the lid unit 10 are formed as the independent component from each other, the valve device 400 can be easily attached to the lid unit 10. In other words, at first, the valve device 400 is inserted into the valve device accommodating portion 14 of the lid unit 10 and then the upper-side strut member 310 is connected to the lid unit 10. As a result, an assembling process for the valve device 400 can be improved and a work efficiency is increased.

Second Embodiment

Figure 17:
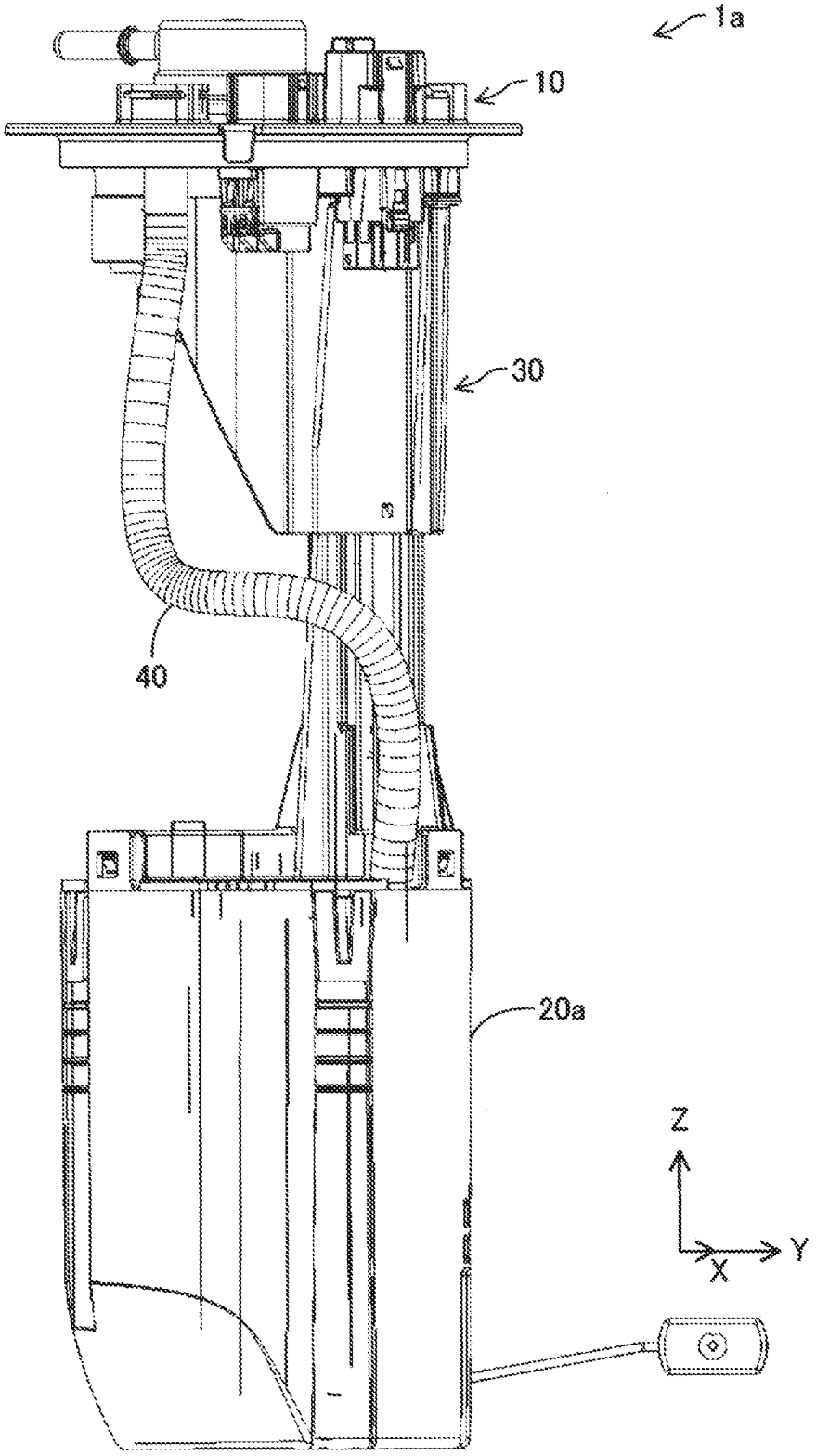
FIG. 17 is a schematic back-side view showing the fuel supply device according to a second embodiment of the present disclosure.

A fuel supply device 1*a* according to a second embodiment shown in FIG. 17 is different from the fuel supply device 1 of the first embodiment in that a pump unit 20*a* is provided instead of the pump unit 20 of the first embodiment. Structures of those portions other than the pump unit 20*a* are the same to those of the first embodiment. FIG. 17 shows the fuel supply device 1*a* in a condition that it is assembled to the fuel tank 2. The fuel tank 2 is omitted in FIG. 17. In FIG. 17, a flexible pipe element 40 is shown, which connects the pump unit 20*a* to the fuel supply port 140 of the lid unit 10.

The pump unit 20*a* has an appearance configuration of an almost cylindrical shape, wherein a center axis direction of the pump unit 20*a* coincides with the vertical direction. Since a function of the pump unit 20*a* is the same to that of the pump unit 20 of the first embodiment, its detailed explanation is omitted. Since the appearance configuration of the pump unit 20*a* has the almost cylindrical shape, a length (a height) of the fuel supply device 1*a* in the Z axis direction is larger than that of the fuel supply device 1 of the first embodiment. Therefore, the fuel supply device 1*a* can be assembled to the fuel tank 2, which has a larger size.

In the present embodiment, according to which the length (the height) of the fuel supply device 1*a* in the Z axis direction is large, a larger moment is applied to the upper-side strut member 310 when the large stress (the external force) is applied to the pump unit 20*a* by the oscillation of the fuel caused by, for example, the collision of the automotive vehicle, because the upper-side strut member 310 is located at a position more separated from the pump unit 20*a*. However, as explained above, since the forward end portion 127 working as the stress concentration portion is formed at such a position, which is largely separated from most of the portions of the strut supporting portion 11 of the lid unit 10 as well as the flanged portion 12 and the connecting sub-unit 13, and the forward end portion 127 is preferentially damaged, It is possible to more surely avoid the situation that those parts of the lid unit 10 other than the first and the second boss portions 111 and 112 of the strut supporting portion 11, such as, the flanged portion 12 and the connecting sub-unit 13, are damaged.

The fuel supply device 1*a* of the second embodiment has the same advantages to those of the fuel supply device 1 of the first embodiment.

FURTHER EMBODIMENTS AND/OR MODIFICATIONS (First Modification)

In the above embodiments, the forward end portion 127 in each of the first and the second boss portions 111 and 112 is formed as the stress concentration portion. However, any other portion of the connecting portion (the engagement portion) between the upper-side strut member 310 and the lid unit 10 may be formed as the stress concentration portion, instead of the forward end portion 127. For example, the boss portions 111 and 112 as well as the fitting portions 321 and 322 are removed, while the protruding portion 311 is formed as the stress concentration portion. In such a modified structure, since the protruding portion 311 is weakened by the multiple through-holes 312, it is preferentially damaged when the large stress is applied from the lower-side strut member 330 to the upper-side strut member 310. As a result, it is possible to avoid the situation that the large stress is applied to the lid unit 10 and thereby the lid unit 10 is damaged.

In addition, the claw portions 324 of the upper-side strut member 310 may be formed as the stress concentration portion. In such a modified structure, the thickness of the claw portion 324 is made thinner, so that the claw portion 324 is preferentially damaged.

In addition, in the above embodiments, the stress concentration portion is formed in the connecting portion (the engagement portion) between the lid unit 10 and the upper-side strut member 310. The stress concentration portion may be formed in any other portion of the fuel supply device 1 or 1*a*. For example, the stress concentration portion may be formed in the lower-side strut member 330. Alternatively, multiple connecting portions may be formed between the lid unit 10 and the upper-side strut member 310, so that the stress may disperse across the multiple connecting portions. For example, multiple snap-fit structures (more than two) may be formed in the intersecting direction, so that the stress may disperse across the multiple snap-fit structures.

(Second Modification)

In the above embodiments, the outer peripheral surface S1 of the front-side portion 126 and the axial end surface S2 of the forward end portion 127 are connected to each other, wherein the outer peripheral surface S1 and the axial end surface S2 are different surfaces from each other. The present disclosure is not limited thereto. For example, the front-side portion 126 and the forward end portion 127 may be connected by the single surface. In other words, the outer peripheral surface of the front-side portion 126 and the outer peripheral surface of the forward end portion 127 may be integrally formed as one continuous surface. Even in such a modified structure, it is possible to transmit the stress from the claw portions 324 to the forward end portion 127, when the large external force is applied from the lower-side strut member 330 to the upper-side strut member 310.

(Third Modification)

In the above embodiments, the first and the second radial gaps G1 and G2 are formed between the boss portion 111/112 and the claw supporting base portion 325 of the fitting portion 321/322. However, one of the radial gaps G1 and G2 may be removed. In other words, the front-side portion 126 and the claw supporting base portion 325 (the insertion hole 327) may be in contact with each other. Alternatively, the base body portion 125 of the boss portion and the claw supporting base portion 325 (the wall portion 328) of the upper-side strut member 310 may be in contact with each other.

(Fourth Modification)

In the above embodiments, the protruding portion 311 and the strut accommodating portion 110 may be removed. In such a modified structure, the upper-side strut member 310 and the lid unit 10 can be connected to each other by the snap-fit engagements between the boss portions 111 and 112 of the lid unit 10 and the fitting portions 321 and 322 of the upper-side strut member 310.

(Fifth Modification)

In the above embodiments, the cross sectional area of the connecting portion between the upper-side strut member 310 and the lid unit 10 in the intersecting direction is larger than the cross sectional area of the connecting portion between the upper-side strut member 310 and the lower-side strut member 330 in the intersecting direction. The present disclosure is not limited thereto. The cross sectional areas of those portions may be the same to each other. Alternatively, the cross sectional area of the connecting portion between the upper-side strut member 310 and the lid unit 10 in the intersecting direction may be smaller than the cross sectional area of the connecting portion between the upper-side strut member 310 and the lower-side strut member 330 in the intersecting direction.

(Sixth Modification)

In the above embodiments, the total area amount of the ribbed portions 130*a* and 130*b* is larger than the area of the contact surface Ar1. The present disclosure is not limited thereto. The total area amount of the ribbed portions 130*a* and 130*b* may be equal to the area of the contact surface Ar1. Alternatively, the total area amount of the ribbed portions 130*a* and 130*b* may be smaller than the area of the contact surface Ar1. Furthermore, the ribbed portions 130*a* and 130*b* may be removed.

(Seventh Modification)

In each of the above embodiments, an ultrasonic sound fuel sender may be provided in an inside space of the strut linking unit 30. More exactly, the ultrasonic sound fuel sender is located in the inside space of the lower-side strut member 330. The inside space of a pipe shape, which extends in the Z axis direction in an inside from the lower-side strut member 330 to the upper-side strut member 310 (the protruding portion 311), is used as an ultrasonic pipe. In such a modified structure, a reflected wave from a liquid surface is detected. A through-hole may be formed in either of the lower-side strut member 330 or the upper-side strut member 310, so that the fuel may flow into the inside space of the pipe.

(Eighth Modification)

In the above embodiments, two boss portions are formed. However, the number of the boss portions is not limited to two, but the boss portions of any other number may be formed. In the above embodiments, the two boss portions 111 and 112 are arranged at such positions across the strut accommodating portion 110. However, the two boss portions may be located at such positions, which are on the same side of the strut accommodating portion 110. In a case that the multiple boss portions are formed, those boss portions may be formed at such positions facing to each other over the accommodation wall portion 110*a* or surrounding the accommodation wall portion 110*a*. In such a modified structure, the upper-side strut member 310 can be connected to the lid unit 10 at a position, which is closer to the portion positioned by the strut accommodating portion 110 and the protruding portion 311. Therefore, the upper-side strut member 310 can be easily connected to the lid unit 10.

(Ninth Modification)

In the above embodiments, the fuel supply device 1 supplies the fuel to the injectors. The present disclosure is not limited thereto. For example, the fuel supply device may supply the fuel to another fuel tank mounted in the automotive vehicle. In addition, the fuel supply device 1 is installed in the automotive vehicle together with the fuel tank 2 in the above embodiment. However, the fuel supply device may be installed in any other types of the vehicles, such as a motor cycle, a ship or the like. Furthermore, the fuel supply device may be assembled in a stationary fuel tank.

The present disclosure is not limited to the above embodiments and/or modifications but can be further modified in various manners without departing from a spirit of the present disclosure.

What is claimed is:

1. A fuel supply device for supplying fuel from a fuel tank comprising:

a pump unit located on a bottom wall of the fuel tank for pumping out the fuel from an inside of the fuel tank to an outside of the fuel tank;

a lid unit attached to an opening formed in an upper-side wall of the fuel tank for closing the opening, wherein a fuel discharge port is formed in the lid unit; and a strut linking unit for connecting the lid unit to the pump unit, wherein the strut linking unit includes:

an upper-side strut member, which is made of resin and formed as an independent component from the lid unit, and which is connected to the lid unit; and a lower-side strut member, which is movably connected to the upper-side strut member in such a way that the lower-side strut member is movable with respect to the upper-side strut member in a linking direction from the lid unit to the pump unit and in a direction opposite to the linking direction, wherein the upper-side strut member includes:

a protruding portion, which is protruding in a direction opposite to the linking direction, and includes a cylindrical wall surface portion; and a first fitting portion and a second fitting portion on both sides of the protruding portion, and wherein the lid unit includes:

a strut supporting portion inserted into the opening of the fuel tank, the strut supporting portion having a strut accommodating portion on a side opposing to the upper-side strut member for accommodating the protruding portion thereon;

a flanged portion connected to an outer periphery of the strut supporting portion and in contact with an outer surface of the fuel tank;

a first boss portion projecting in the linking direction; and a second boss portion projecting in the linking direction, and wherein the first fitting portion includes:

a first claw supporting base portion, which has a first insertion hole, into which the first boss portion is inserted; and a first claw portion formed at a position surrounding the first insertion hole, and defining a radial gap between the first boss portion and the first claw supporting base portion, in a condition that the first boss portion is snap-fitted to the first claw portion, and wherein the second fitting portion includes:

a second claw supporting base portion, which has a second insertion hole, into which the second boss portion is inserted; and a second claw portion formed at a position surrounding the second insertion bole, and defining a radial gap between the second boss portion and the second claw supporting base portion, in a condition that the second boss portion is snap-fitted to the second claw portion, and wherein a forward end portion of the first boss portion and a forward end portion of the second boss portion are formed as a stress concentration portion which is coupled to a connecting portion between the lid unit and the upper-side strut member in such a way that a stress is concentrated on the stress concentration portion when the stress is applied to the lower-side strut member in an intersecting direction, which intersects with the linking direction, and wherein multiple through-holes are formed in the cylindrical wall surface portion of the protruding portion so that stiffness of the protruding portion is made smaller than stiffness of the strut accommodating portion.

2. The fuel supply device according to claim 1, wherein the first boss portion includes:

a base body portion formed on a side opposite to the forward end portion of the first boss portion; and a front-side portion formed between the base body portion and the forward end portion of the first boss portion, a thickness of the front-side portion is smaller than a thickness of the base body portion, and an outer peripheral surface of the front-side portion and an axial end surface of the forward end portion of the first boss portion are formed by different surfaces, so that the outer peripheral surface of the front-side portion and the axial end surface of the forward end portion of the first boss portion are connected to each other in a non-continuous surface.

3. The fuel supply device according to claim 1, wherein a cross-sectional area of the connecting portion between the upper-side strut member and the lid unit in the intersecting direction, which intersects with the linking direction, is larger than a cross-sectional area of another connecting portion between the upper-side strut member and the lower-side strut member in the intersecting direction.

4. The fuel supply device according to claim 1, wherein the strut supporting portion includes a ribbed portion, in which multiple ribs protruding in the linking direction are formed, the strut supporting portion includes a contact surface, at which the lid unit and the upper-side strut member are in contact with each other, and the ribbed portion has a ribbed area larger than the contact surface.

* * * * *